US010907473B2

(12) United States Patent
Rogel et al.

(10) Patent No.: US 10,907,473 B2
(45) Date of Patent: Feb. 2, 2021

(54) LOW VOLUME IN-LINE FILTRATION METHODS FOR ANALYZING HYDROCARBON-CONTAINING FLUID TO EVALUATE ASPHALTENE CONTENT AND BEHAVIOR DURING PRODUCTION OPERATIONS

(71) Applicant: Chevron U.S.A. Inc., San Ramon, CA (US)

(72) Inventors: Estrella Rogel, Orinda, CA (US); Cesar Ovalles, Walnut Creek, CA (US); Michael Moir, San Rafael, CA (US)

(73) Assignee: Chevron U.S.A., Inc., San Ramon, CA (US)

( * ) Notice: Subject to any disclaimer, the term of this patent is extended or adjusted under 35 U.S.C. 154(b) by 340 days.

(21) Appl. No.: 15/811,972

(22) Filed: Nov. 14, 2017

(65) Prior Publication Data

US 2019/0145255 A1 May 16, 2019

(51) Int. Cl.
*E21B 37/06* (2006.01)
*E21B 49/08* (2006.01)

(52) U.S. Cl.
CPC ..... *E21B 49/086* (2013.01); *E21B 37/06* (2013.01)

(58) Field of Classification Search
None
See application file for complete search history.

(56) References Cited

U.S. PATENT DOCUMENTS

| | | | |
|---|---|---|---|
| 3,793,189 | A | 2/1974 | Corbett |
| 4,595,667 | A | 6/1986 | Takase |
| 4,634,680 | A | 1/1987 | Kingsley |
| 4,843,247 | A | 6/1989 | Yamazoe |
| 5,143,594 | A | 9/1992 | Schabron et al. |
| 5,374,350 | A | 12/1994 | Heck |
| 5,911,954 | A | 6/1999 | Ford et al. |
| 6,039,885 | A | 3/2000 | Behar |
| 6,087,662 | A | 7/2000 | Wilt |
| 6,180,683 | B1 | 1/2001 | Miller et al. |
| 6,197,075 | B1 | 3/2001 | Muir |
| 6,773,921 | B1 | 8/2004 | Schabron et al. |
| 7,790,646 | B2 | 9/2010 | Lopez et al. |

(Continued)

FOREIGN PATENT DOCUMENTS

| | | |
|---|---|---|
| CA | 2326288 | 5/2001 |
| EP | 0795579 A1 | 9/1997 |

(Continued)

OTHER PUBLICATIONS

Al-Jarrah M.F., et al., Fuel Science Technology Int. I, 4, 1986, pp. 249-260.

(Continued)

*Primary Examiner* — Angela M DiTrani Leff
(74) *Attorney, Agent, or Firm* — Ryan, Mason & Lewis, LLP

(57) ABSTRACT

A method includes analyzing a carbonaceous deposit for an asphaltene content from a hydrocarbon-containing fluid located in a well, a wellhead or a production line proximate the wellhead, and applying one or more preventative measures to the hydrocarbon-containing fluid located in the well, the wellhead or the production line proximate the wellhead based on the asphaltene content.

17 Claims, 15 Drawing Sheets

(56) References Cited

U.S. PATENT DOCUMENTS

| | | | | |
|---|---|---|---|---|
| 8,236,564 | B2 | 8/2012 | Pauli et al. | |
| 8,241,920 | B2 | 8/2012 | Schabron et al. | |
| 8,273,581 | B2 | 9/2012 | Schabron et al. | |
| 8,367,425 | B1 | 2/2013 | Schabron et al. | |
| 8,492,154 | B1 | 7/2013 | Schabron et al. | |
| 8,530,240 | B1 | 9/2013 | Schabron et al. | |
| 8,628,970 | B1 | 1/2014 | Schabron et al. | |
| 8,658,030 | B2 | 2/2014 | Osaheni et al. | |
| 9,321,967 | B2 * | 4/2016 | Filby | C10G 1/04 |
| 9,353,317 | B2 | 5/2016 | Schabron et al. | |
| 9,458,389 | B1 | 10/2016 | Schabron et al. | |
| 9,671,384 | B2 | 6/2017 | Rogel et al. | |
| 2003/0211621 | A1 | 11/2003 | Rovani, Jr. | |
| 2004/0039125 | A1 | 2/2004 | Breuer et al. | |
| 2004/0050752 | A1 | 3/2004 | Leinweber et al. | |
| 2004/0163995 | A1 | 8/2004 | Cornelisse | |
| 2004/0232042 | A1 | 11/2004 | Mukkamala | |
| 2004/0232043 | A1 | 11/2004 | Mukkamala | |
| 2004/0232044 | A1 | 11/2004 | Mukkamala | |
| 2004/0238404 | A1 | 12/2004 | Mukkamala | |
| 2005/0082231 | A1 | 4/2005 | Gochin | |
| 2005/0091915 | A1 | 5/2005 | Behler | |
| 2006/0079434 | A1 | 4/2006 | Banavali et al. | |
| 2006/0096757 | A1 | 5/2006 | Berry et al. | |
| 2006/0096758 | A1 | 5/2006 | Berry et al. | |
| 2007/0048874 | A1 | 3/2007 | Schabron et al. | |
| 2007/0056881 | A1 | 3/2007 | Berkowitz | |
| 2008/0056822 | A1 | 3/2008 | Hall | |
| 2008/0251418 | A1 | 10/2008 | Francisco | |
| 2009/0052986 | A1 | 2/2009 | Hall | |
| 2009/0057196 | A1 | 3/2009 | Leta | |
| 2009/0159505 | A1 | 6/2009 | Da Costa | |
| 2009/0163350 | A1 | 6/2009 | Da Costa | |
| 2009/0242459 | A1 | 10/2009 | Soloveichik | |
| 2010/0136698 | A1 | 6/2010 | Dadic | |
| 2010/0182591 | A1 | 7/2010 | Chambon | |
| 2010/0251935 | A1 | 10/2010 | Pauli et al. | |
| 2011/0066441 | A1 | 3/2011 | Ovalles | |
| 2011/0098507 | A1 | 4/2011 | Cohrs | |
| 2011/0120950 | A1 | 5/2011 | Schabron et al. | |
| 2011/0152136 | A1 | 6/2011 | Hughes | |
| 2011/0172924 | A1 * | 7/2011 | Hughes | C09K 8/594 702/11 |
| 2011/0198264 | A1 | 8/2011 | Tanaka et al. | |
| 2011/0247964 | A1 | 10/2011 | Den Boestert | |
| 2011/0278460 | A1 | 11/2011 | Respini | |
| 2012/0160015 | A1 | 6/2012 | Ovalles et al. | |
| 2013/0067991 | A1 | 3/2013 | Schabron | |
| 2013/0104772 | A1 | 5/2013 | Schabron | |
| 2013/0124105 | A1 | 5/2013 | Rogel | |
| 2013/0124106 | A1 | 5/2013 | Rogel | |
| 2013/0312501 | A1 | 11/2013 | Dewey et al. | |
| 2014/0020456 | A1 | 1/2014 | Dreyfus et al. | |
| 2014/0021101 | A1 | 1/2014 | Schabron | |
| 2014/0021116 | A1 | 1/2014 | Ford et al. | |
| 2014/0130581 | A1 * | 5/2014 | Ovalles | C09K 8/04 73/61.55 |
| 2014/0369889 | A1 | 12/2014 | Mostowfi | |
| 2014/0375991 | A1 | 12/2014 | Schneider | |
| 2015/0218461 | A1 | 8/2015 | Schabron | |
| 2015/0225655 | A1 | 8/2015 | Adams | |
| 2016/0169858 | A1 * | 6/2016 | Rogel | G01N 33/2835 73/61.55 |
| 2019/0209988 | A1 * | 7/2019 | Schabron | C08L 95/005 |
| 2019/0211272 | A1 * | 7/2019 | Schabron | B01J 20/286 |

FOREIGN PATENT DOCUMENTS

| | | | |
|---|---|---|---|
| EP | 1091085 | | 4/2001 |
| NL | 9200043 | A | 8/1993 |
| RU | 2172817 | C1 | 8/2001 |
| RU | 2173320 | C1 | 9/2001 |
| RU | 2185412 | C1 | 7/2002 |
| RU | 2237799 | C2 | 1/2004 |
| RU | 2223294 | C1 | 2/2004 |
| RU | 2220999 | C1 | 10/2004 |
| RU | 2250247 | C1 | 4/2005 |
| RU | 2261887 | C1 | 10/2005 |
| RU | 2261983 | C2 | 10/2005 |
| WO | 8801180 | | 2/1988 |
| WO | 9314147 | A1 | 1/1993 |
| WO | 9719987 | | 6/1997 |
| WO | 9916810 | | 4/1999 |
| WO | 0056804 | | 9/2000 |
| WO | 0058388 | | 10/2000 |
| WO | 0125214 | A1 | 4/2001 |
| WO | 200174966 | A1 | 10/2001 |
| WO | 2004033602 | A1 | 4/2004 |
| WO | 2005010126 | A1 | 2/2005 |
| WO | 2005054321 | A1 | 6/2005 |
| WO | 2006047745 | A1 | 5/2006 |

OTHER PUBLICATIONS

Barton, A.F.M., Handbook of Solubility, CRC Press, 2nd Edition, 1991, pp. 88-93.

Barton, A.F.M., Handbook of Solubility Parameters and other Cohesion Parameters, CRC Press, USA, 2nd Edition 1991, p. 63.

Barton, A.F.M., Handbook of Solubility Parameters and Other Cohesion Parameters, CRC Press, USA, 2nd Edition 1991, pp. 104-107.

Barton, A.F.M., Handbook of Solubility; CRC Press, 2nd Edition, 1991, pp. 288-289.

Barton, A.F.M., Handbook of Solubility Parameters and Other Cohesion Parameters; CRC Press Inc.: Boca Raton, FL, 1983, p. 95.

Carbognani, et al., Energy Fuels, 2002, 16, 1348.

Ceballo, et al., Petroleum Science and Technology, 1999, 17, 783.

Johson et al., "Pretreatment of resid FCC feestocks", Jul. 2004, http://www.digitalrefining.com/article/1000161.

Mariaca-Domanguez et al., "Reactivity of Fluid Catalytic Cracking Feedstocks as a Function of Reactive Hydrogen Content", Petroleum Science and Technology, 2004, vol. 22, Issue 1-2, pp. 13-29.

McLean et al., "Reactivity Screening of Feedstocks for Catalytic Coal/Oil Co-Processing", ACS Fuel Preprint, Sep. 1986, pp. 169-180: http://web.anl.gov/PCS/acsfuel/preprint%20archive/Files/31_4_Anaheim_09-86_0169.pdf.

Mitchell, et al., Fuel, 1973, 52, 151.

Snyder et al., Practical HPLC Method Development Wiley and Sons, 1997, p. 208.

Snyder et al., Introduction to Modern Liquid Chromatography, 1997, Wiley, p. 208.

Xu et al., "Catalytic hydrotreatment of coal-derived naphtha," ACS Fuel Preprint, Aug. 1991: http://web.anl.gov/PCS/acsfuel/preprint%20archive/Files/36_4_NEW%20YORK_08-91_1909.pdf.

Yang et al., "Characteristics on HDS and HDN kinetics on narrow fractions from residua", ACS Fuel Preprint, Aug. 1998 http://web.anl.gov/PCS/acsfuel/preprint%20archive/Files/43_3_BOSTON_08-98_0751.pdf.

Moschopedis, et al., Fuel, 1971, 50, 34.

Stanislaus et al., "Pilot Plant Study of the Performance of an Industrial Mo03/A1203 Catalyst in Hydrotreatment of Kuwait Atmospheric Residue", ACS Fuel Preprints, Aug. 1999: http://web.anl.gov/PCS/acsfuel/preprint%20archive/Files/44_4_NEW%200RLEANS_08-99_0827.pdf.

Alvarez et al., "Modeling simulation and analysis of heavy oil hydroprocessing in fixed-bed reactors employing liquid quench stream," Applied Catalysis A: General 2009, v. 361, pp. 1-12.

Liaw et al. "Catalytic Hydrotreatment of Coal-Derived Naphtha Using First Row Transition Metal Sulfides", ACS Fuel Preprint, Aug. 1993, pp. 1065-1072: http://web.anl.gov/PCS/acsfuel/preprint%20archive/files/38_3_CHICAG0_08-93_1065.pdf.

Matsushita et al., "Relation between relative solubility of asphaltenes in the product oil and coke deposition in residue hydroprocessing," Fuel, 2004, 83, pp. 1669-1674.

VICI JOUR—Filters and Mobile Phase Filters, VICI AG International, 2013.

(56) References Cited

OTHER PUBLICATIONS

Fan, et al. (2010) "Investigation of Fouling Mechanisms of a Light Crude Oil Using an Alcor Hot Liquid Process Simulator", Energy & Fuels, pp. 6110-6118.

Watkinson, et al. (2000) "Fouling of a Sweet Crude Oil Under Inert and Oxygenated Conditions", Energy & Fuels, pp. 64-69.

Dickakian, et al. (1988) "Asphaltene Precipitation Primary Crude Exchanger Fouling Mechanism", Technology, pp. 47-50.

Watkinson (2003) "Heat of Crude Oil Fouling Using Two Different Probes", ECI Digital Archives, pp. 1-7.

Garcia (2001) "Asphaltenes Deposition Control in Lake Maracaibo Crude Oil Production", SPE International Symposium, pp. 1-9.

Al-Sahhaf, Taher A. et al., "Retardation of asphaltene precipitation by addition of toluene, resins, deasphalted oil and surfactants," Fluid Phase Equilibria, 194-197 (2002) pp. 1045-1057.

Xiang et al., "Ultrahigh pressure liquid chromatography using elevated temperature," Journal of Chromatography A, 1104 (2006) 198-202.

U.S. Appl. No. 60/711,599, date of publication Jul. 23, 2013.

M.M. Boduszynski et al., "Separation of Solvent-Refined Coal into Solvent-Derived Fractions," Analytical Chemistry, 1982, pp. 372-375, vol. 54, No. 3.

F.P. Burke et al., "Liquid Column Fractionation: A Method of Solvent Fractionation of Coal Liquefaction and Petroleum Products," Fuel, 1979, pp. 539-541, vol. 28, No. 7.

F.K. Schweighardt et al., "Evaluation of Analytical Techniques for SRC-1 Characterization, Recycle Solvent Studies, and Product Fractionation Studies: Development of SRC-1 Product Analysis," United States Department of Energy Technical Report No. DOE/OR/03054-61-vol. 2, Sep. 1983, pp. 250 and 276.

http://www.restek.com/catalog/view/10607.

http://www.slb.com/~/media/Files/core_pvt_lab/product_sheets/fluid_lab_equipment_phase_behavior_cells_ps.pdf.

* cited by examiner

LOW VOLUME IN-LINE FILTRATION METHODS FOR ANALYZING HYDROCARBON-CONTAINING FLUID TO EVALUATE ASPHALTENE CONTENT AND BEHAVIOR DURING PRODUCTION OPERATIONS

BACKGROUND

The present invention generally relates to a series of low volume, in-line filtration methods used for analyzing a hydrocarbon-containing fluid located in a well, wellhead or a production line proximate the wellhead to evaluate asphaltene content and behavior in order to predict, prevent or remediate the occurrence of asphaltene deposition during production operations including enhanced oil recovery and control treatments.

Hydrocarbon-containing fluids generally contain polar core materials, such as asphaltenes, dispersed in lower polarity solvent(s). Intermediate polarity material(s), usually referred to as resin(s), can associate with the polar core materials to maintain a homogeneous mixture of the components.

Asphaltenes are organic heterocyclic macromolecules which occur in crude oils. Under normal reservoir conditions, asphaltenes are usually stabilized in the crude oil by maltenes and resins that are chemically compatible with asphaltenes, but that have lower molecular weight. Polar regions of the maltenes and resins surround the asphaltene while non-polar regions are attracted to the oil phase. Thus, these molecules act as surfactants and result in stabilizing the asphaltenes in the crude. However, changes in pressure, temperature or composition of the crude oils can alter the stability of the dispersion and increase the tendency of the asphaltenes to agglomerate into larger particles contributing to the formation of deposits. As these asphaltene agglomerates grow, so does their tendency to precipitate out of solution. Generally, unwanted asphaltene precipitation is a concern in upstream applications due to, for example, plugging of an oil well or pipeline as well as stopping or decreasing oil production. For example, it has been estimate that each remediation event to put a plug well again into production costs around $500,000 (well onshore) or $3,000,000 (well off shore) and three days of shut-in production.

Flow assurance issues in wells as well as in production facilities can be caused by natural declining of the well, i.e. decrease in pressure as by changes in production operations such as starting commingling operations, applying chemical treatments and/or beginning Enhanced Oil Recovery (EOR), i.e. CO2 flooding, steam injection, etc. In particular, it is well known that commingling production, acidification treatments and CO2 flooding pose big challenges in terms of asphaltene control.

It would be desirable therefore to provide improved methods to evaluate the effect that Improved Oil Recovery (IOR), and Enhanced Oil Recovery (EOR) processes as well as chemical treatments (i.e., acidification or additives) might have on asphaltene behavior in terms of altering asphaltene tendency towards precipitation. This would allow taking steps to mitigate the occurrence of asphaltene precipitation before it deteriorates operations and requires remediation.

It would also be desirable to screen and select asphaltene dispersant additives to prevent or inhibit asphaltene precipitation in produced crude oil.

Other measures for preventing asphaltene precipitation include but are not limited to Downhole pressure maintenance, solvent addition, elevated temperature, etc.

Furthermore, predicting asphaltene behavior using hydrocarbon-containing fluid from exploratory wells is critical in the design of production facilities and wells. A bad design due to inaccurate information can lead at the presence of blockages in pipelines and decrease production.

It would be therefore desirable to provide improved low volume, in-line filtration methods for analyzing a hydrocarbon-containing fluid located in a well, wellhead or a production line proximate the wellhead to evaluate asphaltene composition and behavior in order to predict, prevent or remediate the occurrence of asphaltene deposition during production operations that can be carried out in a simple, cost efficient and repeatable manner.

SUMMARY

In accordance with one embodiment of the present invention, there is provided a method comprising the steps of:

(a) providing one or more carbonaceous deposits from a hydrocarbon-containing fluid located in a well, a wellhead or a production line proximate the wellhead, wherein the one or more carbonaceous deposits have an inorganic portion and an organic portion;

(b) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(c) removing the solid particles of the inorganic portion of the one or more carbonaceous deposits from the first solution to provide a second solution containing the dissolved organic portion;

(d) contacting the second solution with one or more alkane mobile phase solvents and capturing any precipitated asphaltenes in one or more low volume filters comprising a porous filter element comprising an area through which a fluid may flow;

(e) determining one or more solubility characteristics of the precipitated asphaltenes;

(f) analyzing the one or more solubility characteristics of the precipitated asphaltenes;

(g) determining an asphaltene content of the second solution from the analyzing step (f); and (h) applying one or more preventative measures to the hydrocarbon-containing fluid located in the well, the wellhead or the production line proximate the wellhead based on the asphaltene content.

In accordance with a second embodiment of the present invention, there is provided a method for optimizing a concentration of one or more asphaltene dispersant additives in a hydrocarbon-containing fluid located in a well, a wellhead or a production line proximate the wellhead, the method comprising the steps of:

(a) selecting a concentration of one or more asphaltene dispersant additives for adding to a hydrocarbon-containing fluid located in a well, a wellhead or a production line proximate the wellhead, wherein the selection of the concentration of the one or more asphaltene dispersant additives comprises receiving data corresponding to the effectiveness of the concentration of the one or more asphaltene dispersant additives for inhibiting or preventing asphaltene precipitation in the hydrocarbon-containing fluid; wherein the data is derived from:

(i) providing one or more carbonaceous deposits from the hydrocarbon-containing fluid located in the well, the wellhead or the production line proximate the wellhead, wherein the one or more carbonaceous deposits have an inorganic portion and an organic portion;

(ii) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(iii) removing the solid particles of the inorganic portion of the one or more carbonaceous deposits from the first solution to provide a second solution containing the dissolved organic portion;

(iv) contacting the second solution with one or more alkane mobile phase solvents and capturing precipitated asphaltenes in one or more low volume filters comprising a porous filter element comprising an area through which a fluid may flow;

(v) determining one or more solubility characteristics of the precipitated asphaltenes;

(vi) analyzing the one or more solubility characteristics of the precipitated asphaltenes;

(vii) determining an asphaltene content of the second solution from the analyzing step (vi);

(vii) providing one or more second carbonaceous deposits from the hydrocarbon-containing fluid in step (a) and containing one or more asphaltene dispersant additives wherein the one or more second carbonaceous deposits have the inorganic portion and the organic portion;

(viii) dissolving the organic portion of the one or more second carbonaceous deposits with the one or more solvents having the solubility parameter of at least about 16.8 $MPa^{0.5}$ and to up to about 30.0 $MPa^{0.5}$ to provide the first solution comprising the solid particles of the inorganic portion of the one or more second carbonaceous deposits and the dissolved organic portion;

(ix) removing the solid particles of the inorganic portion of the one or more second carbonaceous deposits from the first solution to provide the second solution containing the dissolved organic portion;

(x) contacting the second solution with the one or more alkane mobile phase solvents and capturing the precipitated asphaltenes in one or more of the same or different low volume filters;

(xi) determining the one or more solubility characteristics of the precipitated asphaltenes;

(xii) analyzing the one or more solubility characteristics of the precipitated asphaltenes;

(xiii) determining the asphaltene content of the second solution from the analyzing step (xii); and (xiv) comparing the asphaltene content from step (vi) with the asphaltene content from step (xiii).

In accordance with a third embodiment of the present invention, there is provide a system, comprising:

a plurality of components;

a memory; and at least one processor coupled to the memory, wherein the at least one processor is configured to operate the plurality of components to cause:

(a) an organic portion of one or more carbonaceous deposits from a hydrocarbon-containing fluid located in a well, a wellhead or a production line proximate the wellhead, wherein the one or more carbonaceous deposits have an inorganic portion and the organic portion, to be dissolved in one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(b) the solid particles of the inorganic portion of the one or more carbonaceous deposits to be removed from the first solution to provide a second solution containing the dissolved organic portion;

(c) the second solution to be contacted with one or more alkane mobile phase solvents and capture any precipitated asphaltenes in one or more low volume filters comprising a porous filter element comprising an area through which a fluid may flow;

(d) one or more solubility characteristics of the precipitated asphaltenes to be determined;

(e) the one or more solubility characteristics of the precipitated asphaltenes to be analyzed; and (f) an asphaltene content of the second solution to be determined from the analyzing step (e).

The methods and systems of the present invention advantageously determine the asphaltene content, if any, from a hydrocarbon-containing fluid located in a well, a wellhead or a production line proximate the wellhead in a simple, cost efficient and repeatable manner by using carbonaceous deposits in the fluid. In this way, preventative measures can be taken in order to, for example, improve flow of a hydrocarbon-containing fluid from the well, wellhead or production line proximate the wellhead. Other advantages of the methods of the present invention include (a) employing an asphaltene solubility profile to evaluate the tendency towards precipitation of asphaltenes in a produced crude oil, (b) employing asphaltene distribution/solubility to evaluate how changes in the way of production or treatments might affect asphaltene behavior; (c) application of low volume, in-filtration methods to monitor changes in asphaltene precipitation tendencies due to application of enhanced oil recovery processes, e.g., steam injection, $CO_2$ flooding, etc., and (d) application of low volume, in-line filtration methods to select leading asphaltene dispersant additives and their optimum concentration to prevent asphaltene precipitation problems.

DETAILED DESCRIPTION OF THE PREFERRED EMBODIMENTS

Figure 1:
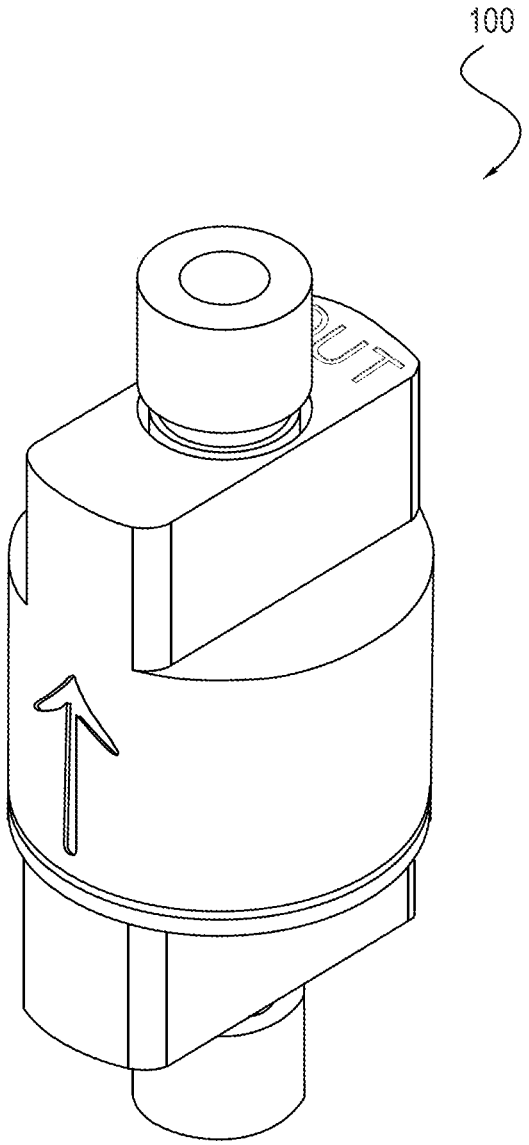
FIG. 1 shows one embodiment of a filter housing assembly for use in the present invention as assembled.

In one embodiment, a method of the present invention determines an asphaltene content of a hydrocarbon-containing fluid located in a well, a wellhead or a production line proximate the wellhead located in a well, wellhead or a production line proximate the wellhead using carbonaceous deposits from the fluid. In general, the method involves the steps of: (a) providing one or more carbonaceous deposits from a hydrocarbon-containing fluid located in a well, a wellhead or a production line proximate the wellhead, wherein the one or more carbonaceous deposits have an inorganic portion and an organic portion; (b) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and the dissolved organic portion; (c) removing the solid particles of the inorganic portion of the one or more carbonaceous deposits from the first solution to provide a second solution containing the dissolved organic portion; (d) contacting the second solution with one or more alkane mobile phase solvents and capturing any precipitated asphaltenes in one or more low volume filters comprising a porous filter element comprising an area through which a fluid may flow; (e) determining one or more solubility characteristics of the precipitated asphaltenes; (f) analyzing the one or more solubility characteristics of the precipitated asphaltenes; (g) determining an asphaltene content of the second solution from the analyzing step (f); and (h) applying one or more preventative measures to the hydrocarbon-containing fluid located in the well, wellhead or a production line proximate the wellhead based on the asphaltene content.

Generally, the one or more carbonaceous deposits can be obtained from a hydrocarbon-containing fluid located in a well, a wellhead or a production line proximate the wellhead. In general, carbonaceous deposits are solids produced, generated or accumulated from petroleum upstream operations which contains organic and inorganic compounds, including but not limited to hydrocarbons and/or asphaltenes. They also contain indigenous material to the reservoir or additives used during production.

The source of the hydrocarbon-containing fluid may be one or more producing wells in fluid communication with a subterranean oil reservoir. The producing well(s) may be under any production conditions such as thermal recovery conditions, carbon dioxide flooding, etc. or the producing well(s) may be in a light, medium or heavy oil field where the hydrocarbon crude or oil is being produced from a reservoir having a strong water-drive. In one preferred embodiment, the source of the hydrocarbon-containing fluid is one that results in a light or medium crude oil.

The carbonaceous deposits are typically in the form of solid particles which can be in a colloidal suspension such as a paste, a slurry or sludge. In general, the carbonaceous deposits will have an inorganic portion and an organic portion. The inorganic portion includes, by way of example, iron oxide, clays, sand, etc. The organic portion includes, by way of example, light components of the crude oil, waxes, asphaltenes, etc.

The organic portion of the one or more carbonaceous deposits is then dissolved with one or more solvents having a solubility parameter of at least about 16.8 $MPa^{0.5}$ and to up to about 30.0 $MPa^{0.5}$ to provide a first solution comprising solid particles of the inorganic portion of the one or more carbonaceous deposits and the dissolved organic portion. A solubility parameter as described herein is determined by the Hansen's methodology described in Barton, A. F. M. *Handbook of Solubility Parameters and Other Cohesion Parameters*; CRC Pres Inc.: Boca Raton, Fla., p. 95 (1983). Useful solvents include any solvent in which the organic portion of the sample is soluble. Representative examples of such solvents include cycloalkyls, e.g., cyclohexane; aromatic hydrocarbons, e.g., toluene; chlorinated hydrocarbons, e.g., dichloromethane; heterocyclic organic solvents, e.g., pyridine, etc.

Once the first solution is formed, substantially all or all of the solid particles of the inorganic portion of the one or more carbonaceous deposits are then removed from the first solution using convention techniques, e.g., filtration, centrifugation, decantation, etc., to provide a second solution containing the dissolved organic portion.

Next, the second solution is contacted with one or more alkane mobile phase solvents and any precipitated asphaltenes are captured in one or more low volume filters comprising a porous filter element comprising an area through which a fluid may flow. Useful one or more alkane mobile phase solvents can be determined by one skilled in the art. In one embodiment, the alkane mobile phase solvent is n-heptane. However, other alkane mobile phase solvents such as, for example, n-pentane or n-hexane may be used.

In one embodiment, the second solution is passed into the one or more low volume filters, and then one or more alkane mobile phase solvents are passed through the one or more low volume filters. The one or more alkane mobile phase solvents should be passed into the one or more low volume filters for a time period sufficient to elute the alkane soluble fraction, commonly known as maltenes or petrolenes, and induce precipitation of the alkane insoluble fraction, i.e., the precipitated asphaltenes, from the second solution. Generally, once the alkane mobile phase solvent (i.e., one or more first solvents) enters the one or more low volume filters, the alkane mobile phase solvent dilutes and displaces the solvent in the second solution, thereby allowing the asphaltenes to substantially precipitate therefrom. The alkane soluble fraction then elutes from the one or more low volume filters.

In another embodiment, the second solution is first combined with one or more alkane mobile phase solvents to induce any precipitation of the asphaltenes from the second solution and form an alkane soluble fraction. The solution is then passed into the one or more low volume filters such that the precipitated asphaltenes are captured in the one or more low volume filters and the alkane soluble fraction is eluted through the one or more low volume filters.

In general, the one or more low volume filters for use in the methods of the present invention can be any suitable one or more low volume filters for separation of particles and/or molecules in a liquid sample. Suitable low volume filters for use herein include those that are commercially available from such sources as, for example, Restek, (State College, Pa.), Idex Health & Science, (Oak Harbor, Wash.), and Phenomenex, (Torrance, Calif.), or those disclosed in, for example, U.S. Pat. No. 5,911,954, and U.S. Patent Application Publication Nos. 20130312501 and 20140021116, the contents of which are incorporated by reference herein. The term "low volume" as used herein shall be understood to mean the volume of the void in the filter where no filter material is present. A suitable low volume filter will have a volume of less than 100 μL, e.g., from about 1 μL to about a 100 μL or from about to 1 μL to about 10 μL.

The one or more low volume filters can be made of low surface energy materials such as, for example, stainless steel, gold, titanium, silver, gold coated stainless steel, titanium coated stainless steel or silver coated stainless steel, carbon composite, nickel-containing alloys such as Hastelloy® Alloy (available from Haynes International), polyaryletherketones, polytetrafluoroethylene, and the like. As one skilled in the art will readily appreciate, and as discussed below, the elements forming the one or more low volume filters can be made of the same or different material. In one preferred embodiment, the low volume filters comprising a porous filter element is generally circular in shape.

The one or more low volume filters will be able to operate at pressures up to about 15,000 psi (about 103421 kPa). In one embodiment, the one or more low volume filters will operate at pressures ranging from about 14 psi (about 97 kPa) to about 15,000 psi. (about 103421 kPa) The one or more low volume filters can operate at room temperature or can be subjected to a temperature up to about 350° C., e.g., a temperature ranging from about 18° C. to about 350° C.

The porous filter element of the low volume filters will comprise an area through which a fluid may flow. As used herein, the term "porous filter element" shall be understood to mean a porous filter element constructed from a woven or non-woven material and excludes a packed media filter. As one skilled in the art will readily appreciate, non-woven material can be a porous material having an area through which a fluid can flow, such as sintered metal particles formed into the porous filter element. In general, the porous filter element will ordinarily have an average pore diameter less than about 10 microns, e.g., an average pore diameter ranging from 0.1 to about 10 microns. In one embodiment, the porous filter element will have an average pore diameter ranging from about 0.1 to about 5 microns. In one preferred embodiment, the porous filter element will have an average pore diameter less than about 1 microns, e.g., an average pore diameter ranging from 0.2 to about 1 microns.

Figure 2:
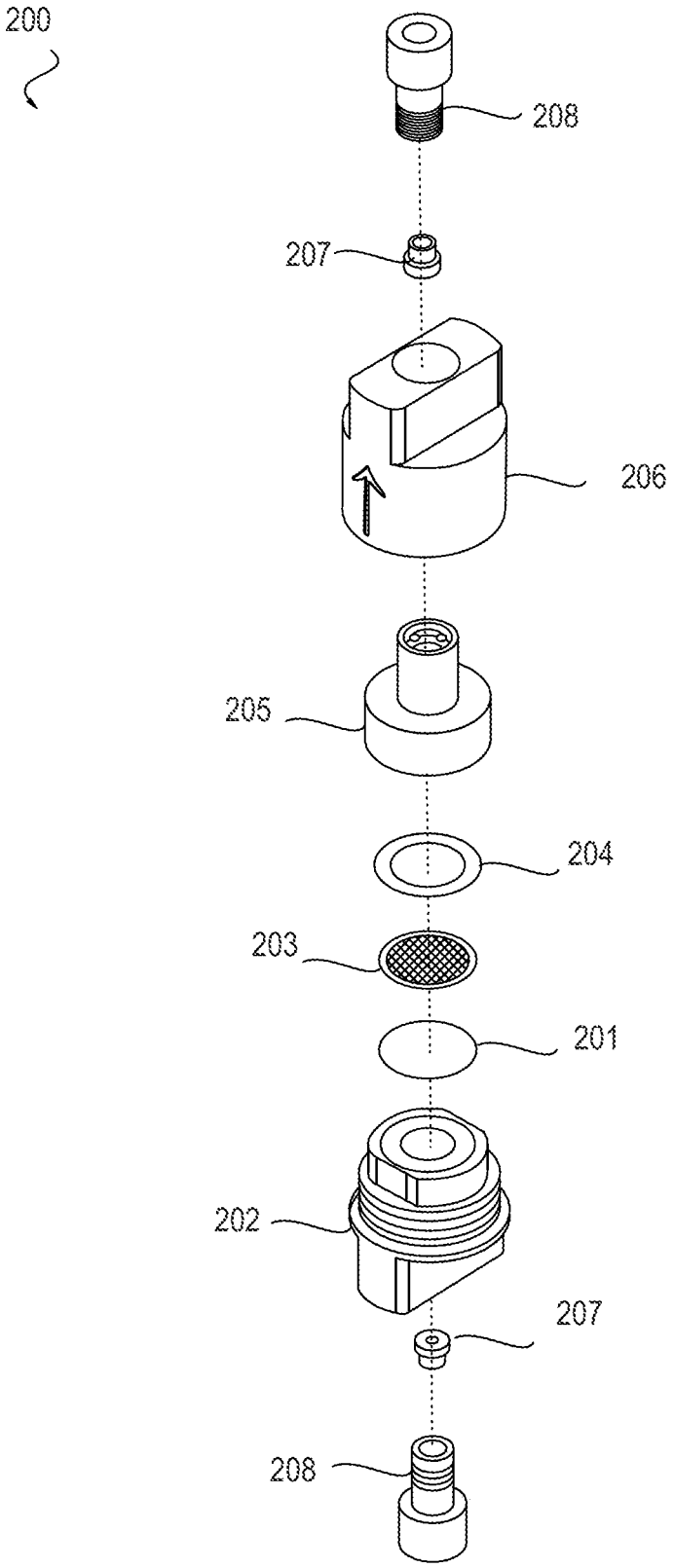
FIG. 2 shows an exploded view an embodiment of a filter housing assembly for use in the present invention with internal elements exposed.

In one embodiment, FIG. 1 illustrates the compact nature of a low volume filter 100 for use in the present invention as well as its simple means of assembly. In the figures, the same or similar reference numbers are used throughout the drawings to denote the same or similar features. FIG. 2 shows the elements of one embodiment of the low volume filters of the present invention. A filter element 201 will be sandwiched between inlet filter housing 202 and porous filter element 203. The porous filter element 203, while porous in the central region may be solid along its perimeter. Typically, this porous filter element does not adsorb sample elements, nor is there an associated depth of material to absorb sample. Further the porous filter element allows a uniform flow through the filter into the chamber downstream therefrom due to the uniformity of the filter. Another benefit of the porous filter element is that there is likely to be less flow impedance over the exposed surface of the filter element.

Upon the perimeter of the filter is seated an O-ring 204 or gasket which seals the filter to the O-ring retainer 205, which is keyed to prevent it from rotating relative to the inlet filter housing 202. The O-ring retainer 205 is threaded to receive a properly threaded outlet fitting. The outlet filter housing 206 is threaded so as to allow it to mate with outlet filter housing 206. As the two halves of the filter housing, inlet filter housing 202 and outlet filter housing 206 are tightened together, they compress the O-ring 204 and seal the assembly. As the O-ring retainer is not threaded, but is keyed to the inlet filter housing 202 it remains fixed relative to the inlet filter housing 202 but allows the outlet filter housing 206 to rotate freely relative thereto during the assembly. This design makes it impossible for the filter element 201 to be rotated during the assembly process, thereby ensuring a fully assembled low volume filter housing assembly 200 of a low volume filter 100 whose integrity has not been compromised by possible tearing or cracking of the filter element while the assembly is sealed.

The assembled low volume filter housing assembly may then be placed in-line with a chromatography or other flowing system as discussed below by connecting tubing from the upstream source to the inlet filter housing by means of a ferrule 207 and a fitting 208. A corresponding ferrule 207 and fitting 208 may be used on the outlet side through which the fluid will be delivered downstream of the filter. In an alternate embodiment of the invention, particularly relevant to lower pressure systems, the inlet filter housing 202 and the outlet filter housing 206 may be threaded so as to receive coned inlet and outlet fittings rather than the flangeless fitting 208 and accompanying ferrule 207 shown in FIG. 2.

Figure 3:
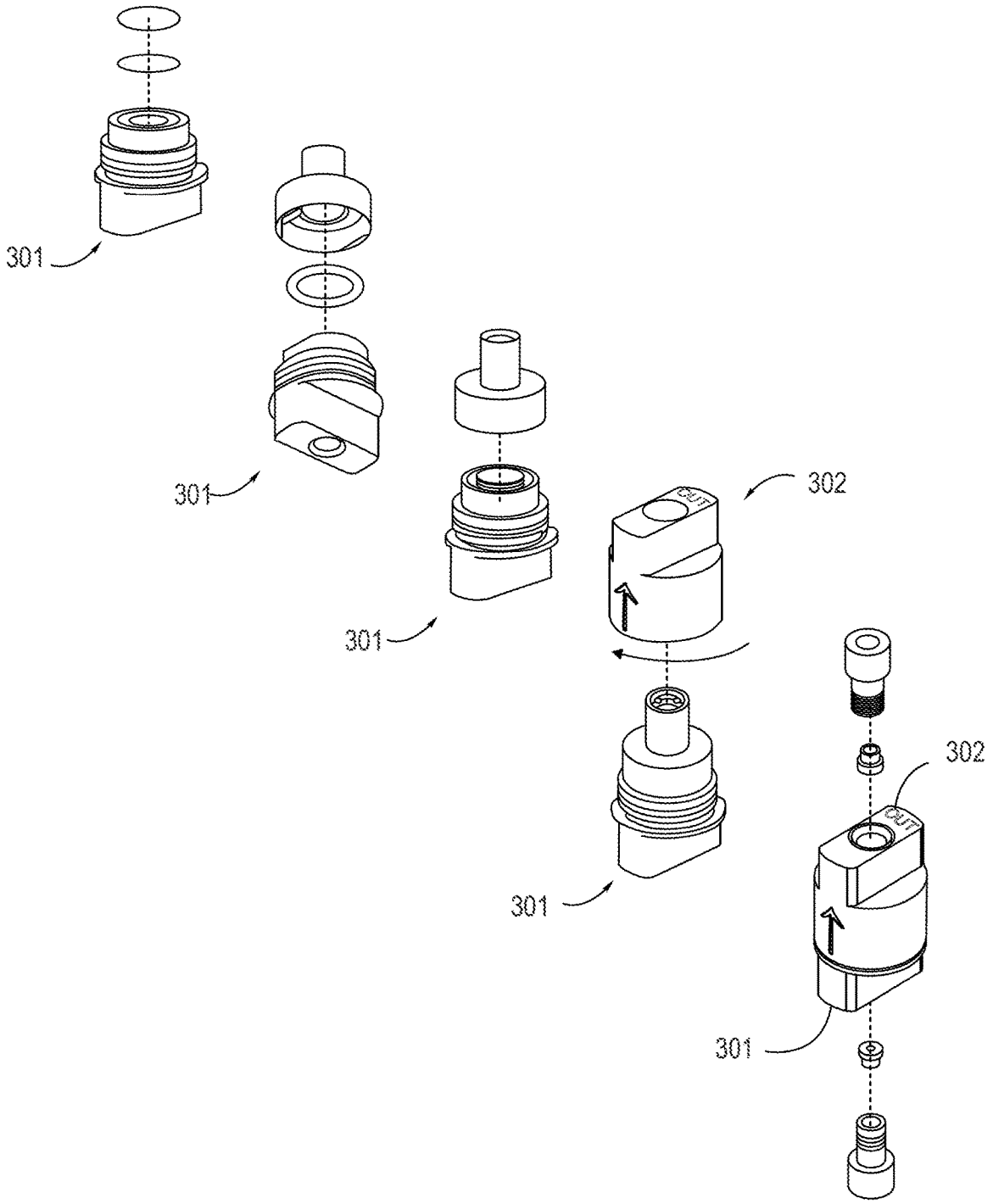
FIG. 3 illustrates a method of assembly for an embodiment of a filter housing assembly for use in the present invention.

FIG. 3 exhibits means by which the low volume filter housing assembly of low volume filter 100 is put together and the elements combined. The filter housing elements 301 and 302 may be screwed together by hand without the need for tools, and the finger tight seal is adequate for even high pressure systems. The same is true when connecting the filter housing assembly to the flowing system by means of finger tight fittings, either cone or flangeless, thus obviating the need for any tools.

Figure 4:
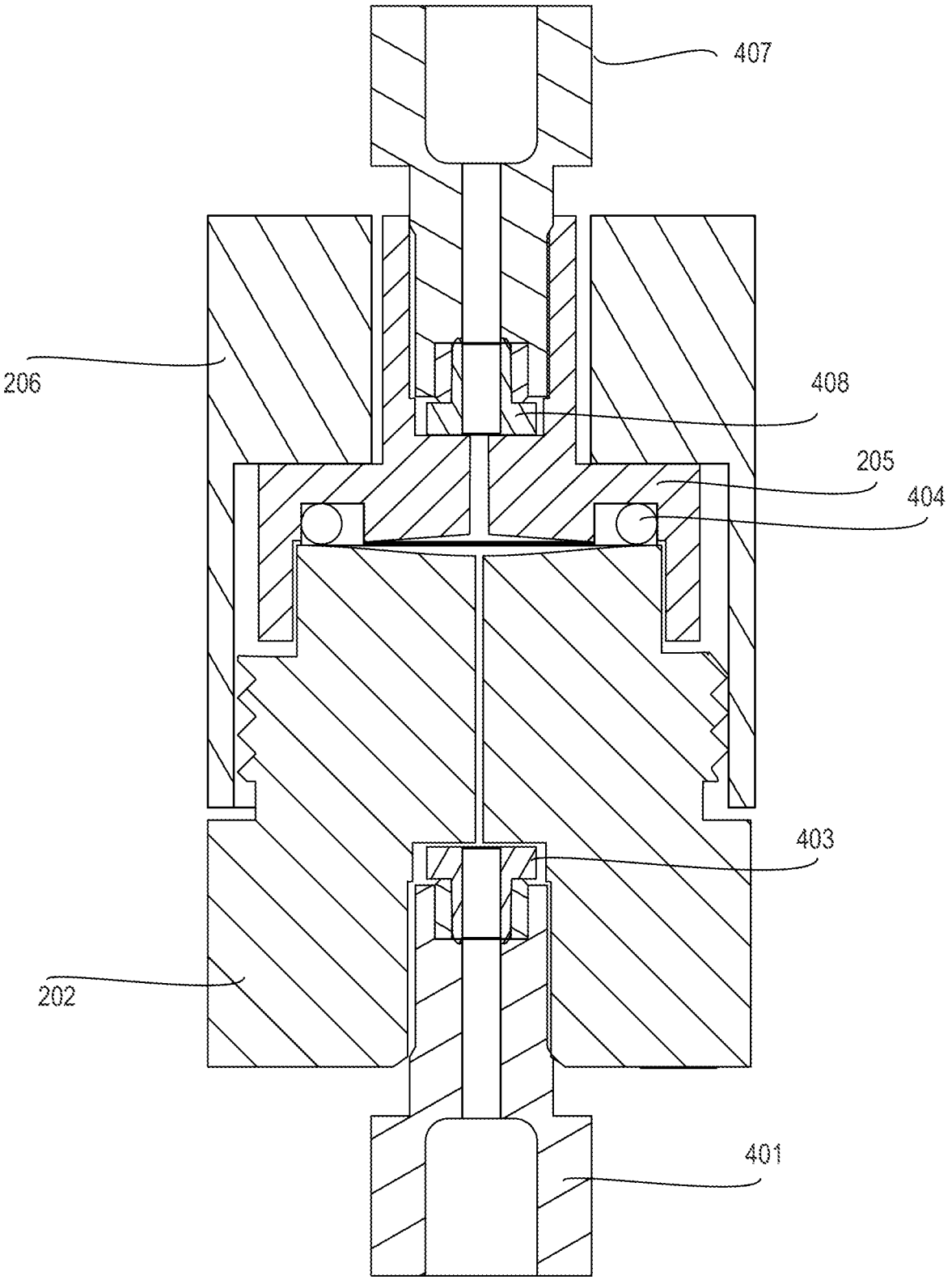
FIG. 4 shows a cross section of an embodiment of a filter housing assembly for use in the present invention when assembled.

A cross section of the assembled low volume filter housing assembly of a low volume filter 100 is illustrated in FIG. 4. In the fully assembled low volume filter housing assembly, the inlet fitting 401 is screwed into the inlet filter housing 202. Ferrule element 403 holds the inlet tubing (not shown) in place. The filter element and porous filter element are sealed by the compressed O-ring 404 which is placed between the filter and porous filter elements and the O-ring retainer 205. The O-ring retainer 205 compresses the compressed O-ring 404 by means of downward pressure applied on the O-ring retainer by the outlet filter housing 206 which is screwed onto the inlet filter housing 202. The outlet fitting 407 is threaded into the O-ring retainer 205 and presses upon the outlet ferrule element 408.

Each element of the low volume filter housing assembly of low volume filter 100 may be made of a material suitable for the desired application as discussed above. For example, if aqueous buffers are to be filtered, it may be important that all wetted elements be non-reactive therewith, and thus wetted elements may be made of polyether ether ketone (PEEK), which is an organic polymer thermoplastic commonly used in high pressure liquid chromatography (HPLC) systems. Alternatively, some organic solvents are incompatible with PEEK, and therefore wetted elements may be made of, for example, stainless steel. In other embodiments, some elements may be made of one material, and other elements may be made of another material. Also non-wetted elements may be chosen for attributes other than reactivity with solvents and samples, such as ease of manufacture, expense or mechanical durability. For example, the outlet filter housing is generally non-wetted, and therefore it could be made of a very durable material such as stainless steel while the remainder of the elements might be made of PEEK.

One element of the low volume filter 100 is the porous filter element 203 as shown in FIG. 2. In one embodiment, this porous filter element is of a woven structure of a suitable metal such as stainless steel and is porous in the central regions of its generally circular shape, but is non-porous at the perimeter, as discussed above. This porous filter element enables a particularly good seal and minimizes potential leakage. However, there are other possible ways to form this porous filter element. For example, the porous filter element might be manufactured in the same way as described above, but fabricated from a different metal such as titanium. Alternatively, it could be made of a combination of materials, such as a stainless steel bound to a PEEK perimeter. In another embodiment, the porous filter element is of a non-woven structure of, for example, PEEK or a carbon composite and is porous in the central regions of its generally circular shape, but can be non-porous at the perimeter, as discussed above. Other possible embodiments do not require that the porous filter element be non-porous along its perimeter, as the compressed O-ring 404 is capable of sealing the system, as shown in FIG. 4, between the O-ring retainer 205 and the inlet filter housing 202.

Figure 5:
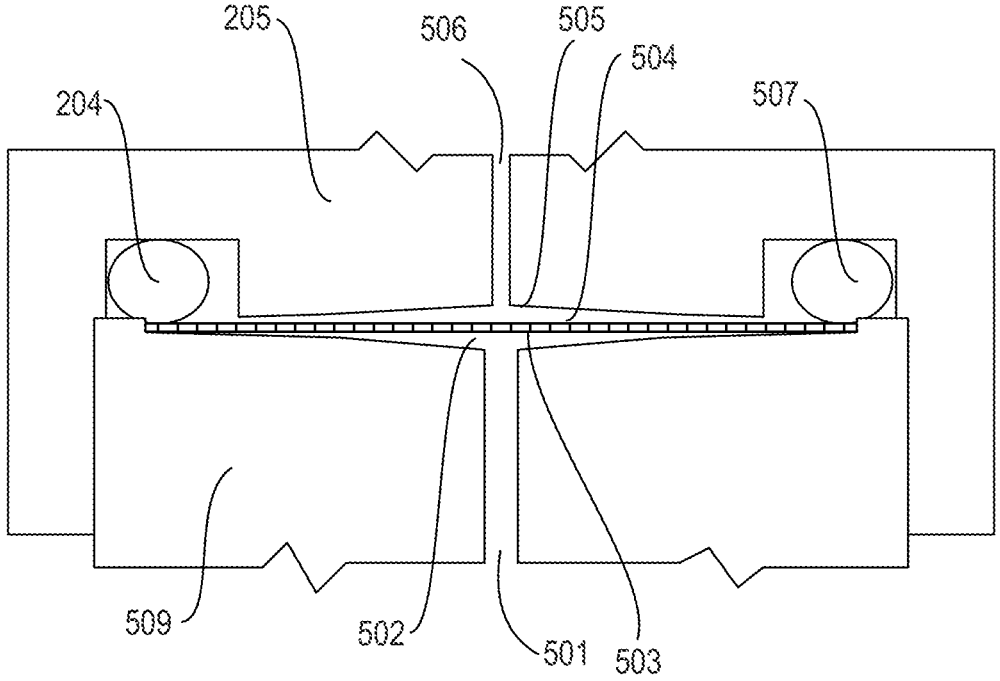
FIG. 5 is a close-up cross section of the flow area near the low volume filter of the assembled invention as shown in FIG. 4.

A close-up cross section of the region surrounding the porous filter element is shown in FIG. 5. Fluid flows through the inlet channel 501 into the inlet 502 until it is of adequate pressure to pass through the porous filter element 503 which is supported by the filter support 504 before filling the outlet 505 and passing into the outlet channel 506. O-ring 204 and 507 are compressed such that a seal is maintained between the O-ring retainer 205 and the filter support 504 and the inlet housing 509. The design enables maximal use of the surface area of the filter element due to the positioning and shape of the inlet and outlet 502 and 505.

Figure 6A:
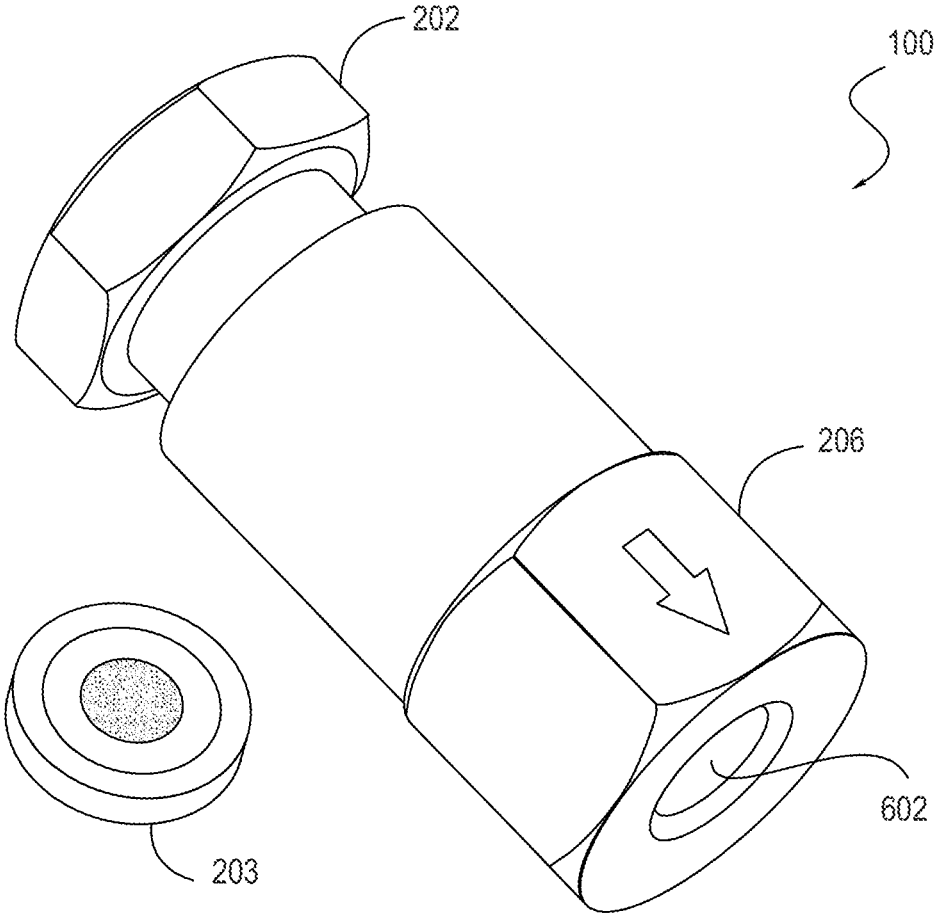
FIG. 6*a* shows one embodiment of a filter housing assembly for use in the present invention as assembled.
Figure 6B:
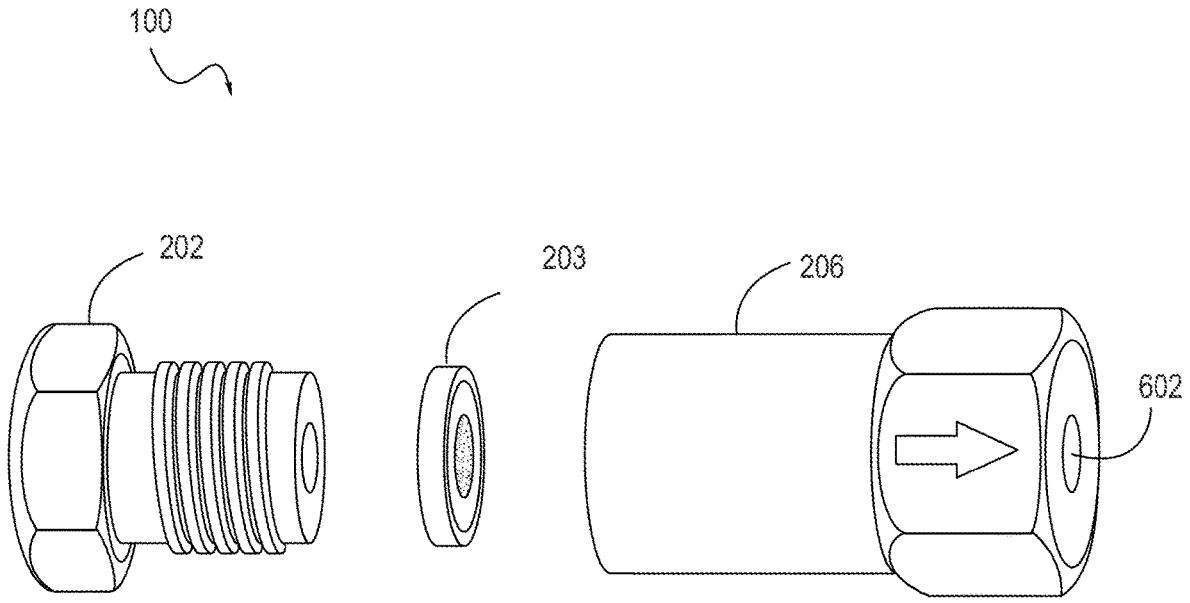
FIG. 6*b* shows a blow apart view of the filter housing assembly of FIG. 6*a*.

In another embodiment of the present invention, FIG. 6*a* illustrates a low volume filter 100 for use in the present invention. FIG. 6*a* shows an inlet filter housing 202 with an opening (not shown) for receiving the flow of the sample to be filtered and an outlet filter housing 206 with opening 602 for flow of the liquid sample, i.e., effluent, of the filtered liquid sample. FIG. 6*a* also shows porous filter element 203. FIG. 6*b* shows an exploded view of low volume filter 100 for use in the present invention. In the fully assembled low volume filter, the inlet filter housing 202 can be operatively connected to outlet filter housing 206 by way of, for example, screwing inlet filter housing 202 into outlet filter housing 206. The opening (not shown) in inlet filter housing 202 will hold an inlet tubing (not shown) in place for receiving the liquid sample to be filtered and opening 602 in outlet filter housing 206 will hold an outlet tubing (not shown). The porous filter element 203 is sealed in the inlet filter housing 202 and outlet filter housing 206 when inlet filter housing 202 is operatively connected to outlet filter housing 206.

The method of fabrication of the one or more low volume filters for use in the methods of the present invention is within the purview of one skilled in the art and need not be discussed herein.

The one or more alkane mobile phase solvents should be passed into the one or more low volume filters to induce the precipitation of the precipitated asphaltenes from the second solution and elute the alkane soluble fraction. In one embodiment, the one or more alkane mobile phase solvents should be passed into the one or more low volume filters to induce the instantaneous precipitation of the precipitated asphaltenes from the second solution and elute the alkane soluble fraction. If no alkane insoluble fraction has precipitated from the solution, then there is no asphaltene content present in the carbonaceous deposit. Accordingly, the preventative measures taken by one skilled in the art would be to simply contact the carbonaceous deposits in the hydrocarbon-containing fluid, where they are present, with a suitable solvent that will be able to dissolve them. In this way, the flow of a hydrocarbon-containing fluid from the well, wellhead or a production line proximate the wellhead can be improved.

The next step of the method of the present invention involves determining one or more solubility characteristics of the precipitated asphaltenes once substantially all of the alkane soluble fraction has eluted. The one or more solubility characteristics of the precipitated asphaltenes to be determined include, by way of example, solubility parameters, miscibility numbers, Kauri-butanol numbers, dipole moments, relative permitivities, polarity indexes, refractive indexes and specific types of intermolecular interaction in liquid media such as acid and base numbers. Various ways to determine the one or more solubility characteristics of the precipitated asphaltenes are within the purview of one skilled in the art. For example, solubility characteristics of the precipitated asphaltenes can be determined according to the following methods: (1) Solubility Fraction Method; and (2) Solubility Profile Method.

Solubility Fraction Method

The solubility fraction method involves the step of determining one or more solubility characteristics of the precipitated asphaltenes by (1) dissolving at least part of the amount of the asphaltenes in one or more first solvents having a solubility parameter at least 0.7 $MPa^{0.5}$ higher than the one or more alkane mobile phase solvents; and (2) dissolving a second amount of the precipitated asphaltenes in one or more second solvents having a solubility parameter higher than the one or more first solvents, wherein the solubility parameter of the one or more second solvents is at least about 21 $MPa^{0.5}$ but no greater than about 30 $MPa^{0.5}$. A solubility parameter as described herein is determined by the Hansen's methodology described in Barton, A. F. M. *Handbook of Solubility Parameters and Other Cohesion Parameters*; CRC Pres Inc.: Boca Raton, Fla., p. 95 (1983).

Suitable one or more first solvents having a solubility parameter at least 0.7 $MPa^{0.5}$ higher than the one or more alkane mobile phase solvents can be determined by one skilled in the art. Useful first solvents include, but are not limited to, one or more alkane solvents, one or more chlorinated hydrocarbon solvents, one or more aromatic solvents, one or more ether solvents, one or more alcohol solvents and the like and mixtures thereof. Representative examples of such solvents can be any of those disclosed above. It is also contemplated that blends of such solvents can be used. In one embodiment, a blend can contain from about 0.5 wt. % to about 99.5 wt. % chlorinated solvent and from about 99.5 wt. % to about 0.5 wt. % alkane solvent. In another embodiment, a blend can contain from about 10 wt. % to about 25 wt. % chlorinated solvent and from about 90 wt. % to about 75 wt. % alkane solvent.

Suitable one or more second solvents having a solubility parameter higher than the one or more first solvents, wherein the solubility parameter of the one or more second solvents is at least about 21 $MPa^{0.5}$ but no greater than about 30 $MPa^{0.5}$, can be determined by one skilled in the art. Generally, the one or more second solvents will dissolve any remaining precipitated asphaltenes captured in the one or more low volume filters. Useful solvents include, but are not limited to, one or more alcohol solvents, one or more chlorinated hydrocarbon solvents, one or more aromatic solvents, one or more ether second solvents and the like and mixtures thereof. Representative examples of such solvents can be any of those disclosed above. It is also contemplated that blends of such solvents can be used. In one embodiment, a blend can contain from about 0.5 wt. % to about 99.5 wt. % chlorinated solvent and from about 99.5 wt. % to about 0.5 wt. % alcohol solvent. In another embodiment, a blend can contain from about 80 wt. % to about 95 wt. % chlorinated solvent and from about 20 wt. % to about 5 wt. % alcohol solvent.

If desired, one or more additional solvents or solvent blends can be used to dissolve at least part of the amount of the precipitated asphaltenes remaining in the one or more low volume filters after the addition of the one or more second solvents and before the addition of the one or more third solvents. In general, the one or more additional solvents or solvent blends will have a solubility parameter greater than the previously added one or more solvents or solvent blends and less than the solubility parameter of the one or more third solvents. For example, one or more third solvents having a solubility parameter between the solubility parameter of the one or more first solvents and the solubility parameter of the one or more second solvents can be added to dissolve at least part of the amount of the precipitated asphaltenes. In another embodiment, one or more fourth solvents having a solubility parameter between the solubility parameter of the one or more third solvents and the solubility parameter of the one or more second solvents can be added to dissolve at least part of the amount of the precipitated asphaltenes. In yet another embodiment, one or more fifth solvents having a solubility parameter between the solubility parameter of the one or more fourth solvents and the solubility parameter of the one or more third solvents can be added to the dissolve at least part of the amount of the precipitated asphaltenes.

Suitable additional solvents include, but are not limited to, one or more alkane solvents, one or more chlorinated hydrocarbon solvents, one or more alcohol solvents, one or more aromatic solvents and the like and mixtures thereof. Representative examples of such solvents can be any of those disclosed above.

The asphaltene concentration in the eluted fractions from the one or more low volume filters is continuously monitored using, for example, a liquid chromatography detector which generates a signal proportional to the amount of each eluted fraction and is recorded in a manner well known in the art. There are a number of commercially available liquid chromatography detectors that can be used including, e.g., refractive index detectors, mass spectrometry, liquid chromatography/mass spectrometry, nuclear magnetic resonance (NMR) spectroscopy, Raman spectroscopy, infrared spectroscopy, fluorescence spectroscopy, UV-Vis spectroscopy, diode array detector, charged aerosol detector, evaporative light scattering detectors (ELSD) and the like; all of which can be used in the methods described herein. Other online detectors are known to those skilled in the art.

In one preferred embodiment, a charged aerosol detector (CAD) is used as a liquid chromatography detector to monitor each eluting sample's concentration to determine the solubility characteristics of the precipitated asphaltenes. The operating principle of a Charged Aerosol detector is as follows: The sample is nebulized into droplets, which are subsequently dried into particles. The particle size increases with the amount of sample. A stream of positively charged gas collides with the sample particles. The charge is then transferred to the particles. These particles are transferred to a collector where the charge is measured by a highly sensitive electrometer. This generates a signal in direct proportion to the quantity of sample present. For example, in the case of the asphaltenes, the result is a single peak for the eluted solvent fraction. The area under the asphaltene peak is then measured using conventional High Performance Liquid Chromatography (HPLC) software packages, Chemstation® by Agilent Technologies (Santa Clara, Calif.), and this area is directly proportional to the asphaltene concentration. In this manner, it is possible to analyze directly effluents which originate from the one or more low volume filters under the condition of selecting a mobile phase which is volatile enough to be directly used as a carrier liquid for the evaporative light scattering detector. For example, in the case of the asphaltenes for the asphaltene fraction method, the result is a single peak for each eluted solvent fraction with each peak representing a solubility characteristic of the asphaltenes.

Solubility Profile Method

The solubility profile method involves the step of determining one or more solubility characteristics of the precipitated asphaltenes by dissolving a first amount and a second amount of the precipitated asphaltenes by gradually and continuously changing the alkane mobile phase solvent to a final mobile phase solvent having a solubility parameter at least 1 $MPa^{0.5}$ higher than the alkane mobile phase solvent. In general, the first amount of the precipitated asphaltenes (also referred to as "easy to dissolve asphaltenes") will have a lower solubility parameter than the second amount of asphaltenes (also referred to as "hard to dissolve asphaltenes"). The term gradually as used herein shall be understood to mean that the alkane mobile phase solvent is incrementally removed from the column over a period of time by continuously adding a final mobile phase solvent having a solubility parameter at least 1 $MPa^{0.5}$ higher than the alkane mobile phase solvent to the one or more low volume filters. Generally, gradually and continuously changing from essentially the alkane mobile phase solvent to the final mobile phase solvent can occur during a period of about 5 minutes to about 120 minutes at a flow rate of about 1 mL/min. to about 4 mL/min. In one embodiment, gradually and continuously changing from the alkane mobile phase solvent to the final mobile phase solvent can occur during a period of about 15 minutes to about 30 minutes at a flow rate of about 1 mL/min. to about 4 mL/min.

The first amount of the precipitated asphaltenes are dissolved by gradually and continuously changing the one or more alkane mobile solvents to a first final mobile phase solvent having a solubility parameter at least 1 $MPa^{0.5}$ higher than the alkane mobile phase solvent. As one skilled in the art will readily appreciate, the selection of the first final mobile phase solvent will depend on such factors as moving from a low solubility parameter solvent (low solvent power) to a high solubility parameter solvent (high solvent power) using solvents that have the right combination of dispersion, polar and hydrogen bonding forces. For example, a first final mobile phase solvent such as a chlorinated hydrocarbon solvent, e.g., dichloromethane, an ether solvent, an aromatic hydrocarbon solvent or mixtures thereof is gradually and continuously added to the column to sequentially change the one or more first solvents from 100% first solvent(s) to 100% first final mobile phase solvent, i.e., the first solvent(s) is changed to 1% dichloromethane in 99% first solvent(s), then to 2% dichloromethane in 98% first solvent(s), until the mobile phase solvent in the column is 100% dichloromethane and 0% first solvent(s). In this manner, a first amount of the precipitated asphaltenes (i.e., easy to dissolve asphaltenes) will be gradually dissolved and a characteristic elution pattern generated, which is referred to as the asphaltene solubility profile, as discussed herein below.

After the first amount of precipitated asphaltenes has been gradually dissolved, a second or remaining amount of the precipitated asphaltenes (which are not capable of being redissolved in the one or more first final mobile phase solvents) is left in the one or more low volume filters. Thus, in order to redissolve the second amount of precipitated asphaltenes, also referred to as hard to dissolve asphaltenes (i.e., higher solubility parameter asphaltenes), it is may be necessary to add one or more second final mobile phase solvents having a solubility parameter at least 1 $MPa^{0.5}$ higher than the first final mobile phase solvent to the column in order to substantially dissolve the remaining amount of the precipitated asphaltenes in the one or more low volume filters and generate a characteristic elution pattern of the hydrocarbon-containing fluid. This can advantageously allow for a more accurate determination of the solubility profile of the various asphaltene components in the hydrocarbon-containing fluid.

The selection of the second final mobile phase solvent will depend on such factors as moving from a lower solubility parameter solvent (the first final mobile phase solvent) to a higher solubility parameter solvent (the second final mobile phase solvent) using solvents that have the right combination of dispersion, polar and hydrogen bonding forces. A suitable one or more second final mobile phase solvent can readily be determined by one skilled in the art, e.g., a $C_1$ to $C_6$ alcohol such as methanol. Accordingly, in one embodiment, methanol is gradually and continuously added to the column to sequentially change the first final mobile phase solvent, e.g., dichloromethane, from 100% dichloromethane to 100% methanol, i.e., dichloromethane is first changed to 1% methanol in 99% dichloromethane, then to 2% methanol in 98% dichloromethane, until the second final mobile phase solvent in the column is 100% methanol and 0% dichloromethane.

The flow rate and time period for gradually and continuously adding the one or more second final mobile phase solvents are substantially the same as for the first final mobile phase solvents.

The asphaltene concentration in the eluted fractions from the one or more low volume filters is continuously monitored using, for example, a liquid chromatography detector as discussed hereinabove. In one preferred embodiment, an evaporative light scattering detector is used as a liquid chromatography detector to monitor each eluting sample's concentration. The operating principle of an evaporative light scattering detector is as follows: the compounds to be analyzed are transported by a mobile phase or a more volatile carrier liquid which is then nebulized and evaporated at a relatively low temperature (being able to be in the order of from about 30 to about 150° C.) so that residual micro-particles alone remain—ideally the compounds to be analyzed—which can be detected by light scattering. In this manner, it is possible to analyze directly effluents which originate from the one or more low volume filters under the condition of selecting a mobile phase which is volatile enough to be directly used as a carrier liquid for the evaporative light scattering detector. For example, in the case of the asphaltenes, the result is a curve that represents the solubility parameter distribution of the asphaltenes.

Next, a solubility profile of the asphaltenes in the liquid sample can be created by techniques known in the art. For example, when asphaltenes are quantified using an evaporative light scattering detector, the result is a curve that represents the solubility parameter distribution of the asphaltene in the hydrocarbon-containing feedstock. Since the solubility parameter of a mixture of solvents is given by the volumetric average of the components, it is possible to convert the time scale of the elution to a solubility parameter scale using the following equation:

$$\delta = \sum_{i=1}^{n} \phi_i \delta_i$$

wherein $\delta$ is the solubility profile of the mixture, $\phi_i$ is the volume fraction and $\delta_i$ is the solubility parameter of each of the components, respectively. The volume fraction is the volume fraction of the blend of each solvent and readily determined by the chromatography apparatus. The solubility parameter of a component is either known in the art, e.g., Barton, A. F. M. *Handbook of Solubility Parameters and Other Cohesion Parameters*; CRC Pres Inc.: Boca Raton, Fla., 1983, or can be determined by techniques within the purview of one skilled in the art.

Next, the asphaltene content can be determined by analyzing the one or more solubility characteristics for a given hydrocarbon-containing fluid as follows.

Solubility Fraction Method

In the solubility fraction method, the result is one peak for each eluted solvent fraction with each peak representing a solubility characteristic of the asphaltenes. The area under the separate peaks can be determined using commercially available software packages for qualitative and quantitative analysis that include quantification of peak area and height. Commercially available software packages include, by way of example, GRAMS/AI package provided by Thermo Galactic (Salem, N.H.) and Chemstation® by Agilent Technologies (Santa Clara, Calif.). Then, each area is correlated to an asphaltene mass according to a calibration curve that depends on the type of detector used as within the purview of one skilled in the art. The calibration may or may not be the same for all the peaks. The total asphaltene mass (TAM) for the sample would therefore be the addition of all the asphaltene masses (M) determined for each peak:

$$TAM = \sum_{i=1}^{n} M_i$$

Solubility Profile Method

In the solubility profile method, the amount of asphaltenes is determined by calculating the area of the second peak of the solubility profile. An asphaltene solubility profile normally shows either two peaks or one peak and one shoulder from the evaporative light scattering detector. The two peaks or peak/shoulder can be separated by numerical methods well known in the art such as, for example, peak deconvolution or peak fitting. The area under the peaks, e.g., the second peak, can be determined using commercially available software packages for qualitative and quantitative analysis that include quantification of peak area and height. Commercially available software packages include, by way of example, GRAMS/AI package provided by Thermo Galactic (Salem, N.H.) and Chemstation® by Agilent Technologies (Santa Clara, Calif.). Then, this area is correlated to an asphaltene mass according to a calibration curve. A calibration procedure was developed that relates the measured peak area (A) to the total asphaltene mass (TAM) in the sample. The following equation is an example of such correlation that allows the calculation of the asphaltene mass:

$$\text{Log TAM}=0.5336 \log A-6.097$$

where TAM is the total asphaltene mass in the sample and A is the area of the second deconvoluted peak respectively.

Once the asphaltene concentration of the sample has been obtained preventative measures can then be applied to (1) the hydrocarbon-containing fluid; or (2) the well, wellhead or a production line proximate the wellhead. For example, preventative measures includes (1) adding a solvent to the hydrocarbon-containing fluid, (2) adding an amount of one or more asphaltene dispersant additives to the hydrocarbon-containing fluid and (3) mechanically cleaning the pipeline or one or more crude hydrocarbon refining components. In this manner, improved flow of the hydrocarbon-containing fluid from a well, a wellhead or a production line proximate the wellhead can be achieved.

In one embodiment of the present invention, there is provided a method for determining an effectiveness of one or more asphaltene dispersant additives for inhibiting or preventing asphaltene precipitation in a hydrocarbon-containing fluid located in a well, a wellhead or a production line proximate the wellhead comprising the steps of:

(a) providing one or more first carbonaceous deposits from a hydrocarbon-containing fluid located in a well, a wellhead or a production line proximate the wellhead, wherein the one or more first carbonaceous deposits have an inorganic portion and an organic portion;

(b) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and the dissolved organic portion;

(c) removing the solid particles of the inorganic portion of the one or more carbonaceous deposits from the first solution to provide a second solution containing the dissolved organic portion;

(d) contacting the second solution with one or more alkane mobile phase solvents and capturing any precipitated asphaltenes in one or more low volume filters comprising a porous filter element comprising an area through which a fluid may flow;

(e) determining one or more solubility characteristics of the precipitated asphaltenes;

(f) analyzing the one or more solubility characteristics of the precipitated asphaltenes;

(g) determining an asphaltene content of the second solution from the analyzing step (f);

(h) providing one or more second carbonaceous deposits from the same hydrocarbon-containing fluid in step (a) and containing one or more asphaltene dispersant additives wherein the one or more second carbonaceous deposits have an inorganic portion and an organic portion;

(i) dissolving the organic portion of the one or more second carbonaceous deposits with one or more solvents having a solubility parameter of at least about 16.8 $MPa^{0.5}$ and to up to about 30.0 $MPa^{0.5}$ to provide a first solution comprising solid particles of the inorganic portion of the one or more second carbonaceous deposits and the dissolved organic portion;

(j) removing the solid particles of the inorganic portion of the one or more second carbonaceous deposits from the first solution to provide a second solution containing the dissolved organic portion;

(k) contacting the second solution with one or more alkane mobile phase solvents and capturing any precipitated asphaltenes in one or more of the same or different low volume filters;

(l) determining one or more solubility characteristics of the precipitated asphaltenes;

(m) analyzing the one or more solubility characteristics of the precipitated asphaltenes;

(n) determining an asphaltene content of the second solution from the analyzing step (m);

(o) comparing the asphaltene content from step (g) with the asphaltene content from step (n).

In general, one or more asphaltene dispersant additives are added to the hydrocarbon-containing fluid prior to removing the one or more carbonaceous deposits. The one or more asphaltene dispersant additives can be any presently known or later-discovered asphaltene dispersant additive, e.g., U.S. Patent Application Publication Nos. 20040039125, 20040050752, 20040163995, 20040232042, 20040232043, 20040232044, 20040238404, 20050082231, 20050091915, 20060079434, 20060096757, and 20060096758, the contents of each of which are incorporated by reference herein. Additional examples of asphaltene dispersant additive can be found in, for example, International Patent Applications Nos. 200174966, 2004033602, 2005010126, 2005054321, and 2006047745; Russian Patent Nos. 2172817, 2173320, 2185412, 2220999, 2223294, 2237799, 2250247, 2261887, and 2261983; Canadian Patent No. 2326288; European Patent No. 1091085; European Patent Application No. 2006795579; and Mexican Patent Application No. 2001013139.

In one embodiment, an asphaltene dispersant additive includes one or more alkyl phenols. In general, the alkyl group on the alkyl phenol is a linear chain or a branched chain alkyl group. In one embodiment, the alkyl group on the alkyl phenol is a mixture of linear chain and branched chain alkyl groups or mixtures thereof. In one embodiment, the branched chain alkyl group on the alkyl phenol has from about 4 carbon atoms to about 60 carbon atoms. In one embodiment, the branched chain alkyl group on the alkyl phenol has from about 6 carbon atoms to about 40 carbon atoms. In one embodiment, the branched chain alkyl group on the alkyl phenol has from about 6 carbon atoms to about 18 carbon atoms.

In one embodiment, the linear chain alkyl group on the alkyl phenol has from about 4 carbon atoms to about 60 carbon atoms. In one embodiment, the linear chain alkyl group on the alkyl phenol has from about 6 carbon atoms to about 40 carbon atoms. In one embodiment, the linear chain alkyl group on the alkyl phenol has from about 6 carbon atoms to about 18 carbon atoms.

In one embodiment, an asphaltene dispersant additive includes one or more alkyl-substituted hydroxyaromatic compounds. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. A preferred hydroxyaromatic compound is phenol.

The alkyl substituted moiety of the alkyl-substituted hydroxyaromatic carboxylic acid is derived from an alpha olefin having from about 6 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 6 to about 30 carbon atoms per molecule. In one embodiment, the normal alpha olefins are isomerized using at least one of a solid, or liquid catalyst.

In one embodiment, an asphaltene dispersant additive includes one or more fatty acid esters, one or more lactic acid esters, and mixtures thereof. Suitable fatty acid esters include, by way of example, $C_1$ to $C_4$ esters of $C_{16}$ to $C_{20}$ fatty acids including edible vegetable oils. Such oils may have a melting point of −10° C. or less. Useful edible vegetable oils include corn, coconut, mustard, palm kernel oil, neem, niger seed, olive, peanut, poppy seed, safflower, rapeseed, sesame, soybean, sunflower seed, wheat germ oil and other polyunsaturated containing oils (such as oleic acid, linoleic acid, erucic acid, and linolenic acid). The $C_{16}$ to $C_{20}$ fatty acid ester may further be a mixture of oils. Edible vegetable oils containing a mixture of about 70 to about 90 weight percent oleic and linoleic acids are often preferred.

Suitable lactic acid esters include a $C_1$ to $C_4$ ester of lactic acid. Exemplary $C_1$ to $C_4$ alcohols for producing the lactic acid ester include methanol, ethanol, propanol, isopropanol, allyl alcohol, butanol, 3-buten-1-ol, t-butanol and sec-butanol. In one embodiment, the lactic acid ester is ethyl lactate. Ethyl lactate is the ester of natural lactic acid produced by fermentation of corn-derived feedstock. As with the fatty acid esters, lactic acid esters are 100% biodegradable, breaking down into carbon dioxide and water, non-toxic, and renewable.

In another embodiment, an asphaltene dispersant additive includes a composition comprising: (i) a chelating aminocarboxylic acid-$C_8$ to $C_{22}$ amine complex; (ii) a $C_{15}$ to $C_{21}$ bis(2-hydroxyethyl)amide; and (iii) a $C_{15}$ to $C_{44}$ imidazoline compound. The chelating aminocarboxylic acid-$C_8$ to $C_{22}$ amine complexes are generally formed by heating the $C_8$ to $C_{22}$ amine with the chelating aminocarboxylic acid. The amounts of amine and chelating aminocarboxylic acid used to form the complexes can vary greatly, depending on several factors such as the particular application, and the composition and physical properties of the heavy crude oil (HCO) or other petroleum product; however, in general the molar equivalent ratio of amine to acid equivalent of chelating aminocarboxylic acid can be in the range of about 10:1 to about 1:2. A chelating aminocarboxylic acid is a compound having an amine group, and having at least two carboxylic acid groups that can form coordinate bonds to a single metal atom. Suitable chelating aminocarboxylic acids include, by way of example, ethylenediaminetetraacetic acid (EDTA), hydroxyethyl ethyl enediaminetriacetic acid, nitrilotriacetic acid (NTA), N-dihydroxyethylglycine and ethylenebishydroxyphenyglycine.

Suitable $C_8$ to $C_{22}$ amines include n-octylamine, 2-ethylhexylamine, t-octylamine, n-decylamine, tertiary-alkyl primary amines (either singly or in any combinations thereof), tridecylamine, n-undecylamine, lauryl amine, hexadecylamine, heptadecylamine, octadecylamine, decenylamine, dodecenylamine, palmitoleylamine, oleylamine, linoleylamine, eicosenylamine and polyetheramine; and polyalkylamines such as polyisobutyleneamine. Commercially available mixtures of suitable primary aliphatic amines in the $C_{12}$ to $C_{18}$ range include ARMEEN O and ARMEEN OD (Akzo Nobel; Stratford, Conn.). It is preferred to use oil-soluble aliphatic amines in which the aliphatic group is a tertiary aliphatic group, most preferably a tertiary alkyl group, e.g., tertiary-alkyl primary amines. Commercially available mixtures of tertiary-alkyl primary amines include 1,1,3,3-tetramethylbutylamine (PRIMENE TOA); an isomeric mixture of $C_{16}$ to $C_{22}$ tertiary alkyl primary amines (PRIMENE JM-T); an isomeric mixture of $C_8$ to $C_{10}$ tertiary alkyl primary amines (PRIMENE BC-9); an isomeric mixture of $C_{10}$ to $C_{15}$ tertiary alkyl primary amines (PRIMENE 81-R); or mixtures thereof. (Rohm and Haas Company; Philadelphia, Pa.).

A suitable $C_{15}$ to $C_{21}$ bis(2-hydroxyethyl)amide is represented by the following formula (I)

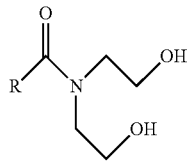

(I)

wherein R is $C_{15}$ to $C_{21}$ alkyl, $C_{15}$ to $C_{21}$ alkenyl, or a mixture thereof For the $C_{15}$ to $C_{44}$ imidazoline compound, the imidazoline ring has at least one $C_{15}$ to $C_{22}$ alkyl or alkenyl side chain. In one embodiment, the imidazoline ring also has an alkenylamide side chain having from 10 to 24 carbon atoms. In one embodiment, the $C_{15}$ to $C_{44}$ imidazoline compound is a $C_{30}$ to $C_{44}$ imidazoline compound. In another embodiment, the imidazoline compound is a reaction product of a fatty acid and a polyamine. Suitable polyamines include, by way of example, ethylenediamine, diethylenetriamine, and hydroxyethyl ethylenediamine. Suitable fatty acids include, by way of example, $C_{12}$ to $C_{20}$ alkyl and/or alkenyl carboxylic acids, including polyunsaturated acids. Suitable fatty acids include oleic, linoleic and fatty acid mixtures derived from tall oil, soybean or palm oils. Preparation of fatty acid-polyamine reaction products is known, and is disclosed, e.g., in WO 01/25214.

In general, the composition can contain from about 10 to about 80% of a chelating aminocarboxylic acid-$C_8$ to $C_{22}$ amine complex, about 10 to about 80% of a $C_{15}$ to $C_{21}$ bis(2-hydroxyethyl)amide, and about 15 to about 80% of a $C_{15}$ to $C_{44}$ imidazoline compound, with all amounts being exclusive of solvents.

In another embodiment, an asphaltene dispersant additive includes at least one compound of the general formula (II)

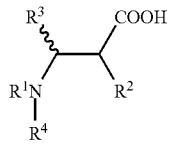

(II)

or a zwitterionic form or salt thereof, wherein $R^1$ is $C_{10}$ to $C_{22}$ alkyl or aralkyl; $R^2$ and $R^3$ independently are hydrogen or $C_1$ to $C_4$ alkyl; $R^4$ is hydrogen, $C_1$ to $C_{22}$ alkyl, $C_7$ to $C_{22}$ alkyl or —$CH(R^5)CH(R^6)COOH$, wherein $R^5$ and $R^6$ independently are hydrogen or $C_1$ to $C_4$ alkyl. Typically, a compound of formula (II) results from reaction of a primary or secondary amine with an unsaturated acid such as acrylic acid, methacrylic acid or crotonic acid, or combinations thereof. Formation of a 1:1 adduct of a primary amine and an unsaturated acid results in a product in which $R^4$ is hydrogen. A 1:2 adduct has $R^4$ equal to $-CH(R^5)CH(R^6)COOH$. An adduct of a secondary amine and an unsaturated acid has $R^4$=$C_{10}$ to $C_{22}$ alkyl or alkyl. In one embodiment, $R^1$ is derived from an unsubstituted $C_{10}$ to $C_{22}$ alkyl amine, $R^1NH_2$, preferably one which is an oil-soluble amine. In one embodiment, the alkyl amine is a tertiary alkyl primary amine, i.e., a primary amine in which the alkyl group is attached to the amino group through a tertiary carbon. Examples of commercially available tertiary alkyl primary amines are the Primene™, amines available from Rohm and Haas Company, Philadelphia, Pa.

In another embodiment, an asphaltene dispersant additive includes at least one reaction product of (a) an amine; and (b) a carboxylic, phosphonic or sulfonic acid. The reaction product has no new covalent bonds, i.e., bonds not present in the amine or the acid. The reaction product is either a salt or a physical mixture or complex of the amine and the acid. In one embodiment, a reaction product used in this invention is a salt, preferably one that is soluble in oil at least at the aforementioned levels. In one embodiment, the salt has at least ten carbon atoms, more preferably at least 15 carbon atoms. The salt, when used in this invention, has a cation and an anion, and is not zwitterionic. In one embodiment, the acid is a carboxylic acid having no other acidic functional groups, i.e., groups having $pK_a$<6. In another embodiment, the acid is a phosphonic acid having no other acidic functional groups. In another embodiment, the acid is a sulfonic acid having no other acidic functional groups.

In another embodiment, an asphaltene dispersant additive includes at least one reaction product of (a) an imine; and (b) an organic acid. In one embodiment in which the organic acid is a carboxylic, phosphonic or sulfonic acid, the separation between a polar group and a carboxylate, phosphonate or sulfonate ion (collectively: "conjugate base group"); or a protonated imine ("conjugate acid group"); is measured by the number of covalent chemical bonds intervening between either: (i) the atom of the polar group through which it is attached (e.g., the oxygen of hydroxy; the nitrogen of amino or nitroso; or the sulfur of sulfur-containing groups); or (ii) a carbonyl or imine carbon of the polar group (e.g., the carbonyl carbon of amide or the imine carbon of oxime); and one of: the carboxylate carbon, the phosphorus atom of a phosphonate, the sulfur atom of a sulfonate and the imine nitrogen atom. For example, in an imine salt of glycolic acid (hydroxyacetic acid), the oxygen of the hydroxy group is two bonds from the carbonyl carbon of the carboxylate group. Preferably, at least one polar group in a compound of this invention is located two to eight chemical bonds from either a conjugate acid or base functional group, more preferably from two to seven chemical bonds, and most preferably two, three, four, five or six chemical bonds from either a conjugate acid or base functional group.

In another embodiment, an asphaltene dispersant additive includes at least one compound having: (i) at least one carboxyl group; (ii) at least one amide group; and (iii) at least fifteen carbon atoms. In one embodiment, the compound is not in the form of a salt having an anion and a cation, i.e., a salt that is not a zwitterion; more preferably the compound is a neutral compound. In one embodiment, a carboxyl or amide functional group is not part of a heterocyclic ring. In one embodiment, the compound is aliphatic. In one embodiment, the compound is acyclic. In one embodiment, the compound is represented by formula (III)

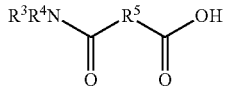

(III)

wherein $R^5$ is $C_1$ to $C_{70}$ difunctional alkyl or $C_6$ to $C_{14}$ difunctional aryl, and $R^3$ and $R^4$ independently are hydrogen or organic functional groups. Preferably, $R^3$ and $R^4$ independently are hydrogen, alkyl, heteroalkyl, heterocyclic, aryl or aralkyl. Preferably, at least one $R^3$, $R^4$ and $R^5$ has at least 12 carbon atoms.

In another embodiment, an asphaltene dispersant additive includes non-sulfonated and sulfonated alkyl phenol formaldehydes. In one embodiment, the sulfonated alkyl phenol formaldehydes are products obtainable by sulfonation of compounds corresponding to formula (IV) or (V):

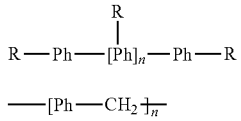

(IV)

(V)

in which n is a number of 2 to 12 and R is a $C_3$ to $C_{24}$ alkyl, $C_6$ to $C_{12}$ aryl or hydroxyaryl or $C_7$ to $C_{12}$ alkyl group. In addition, Ph in formula (I) and (II) is a phenol residue.

The sulfonation products are obtained by sulfonation of compounds known per se corresponding to general formulae (IV) and/or (V). These starting products are known, for example, from DE 197 09 797 A1. Reference is made here to formulae (IV) and (V) in claim 1 of DE 197 09 797 A1, to the disclosure on page 2, lines 40 to 44 and to the disclosure on page 3 of that document. The disclosures of those passages are specifically included in the disclosure of the present application. Formulae (IV) and (V) in DE 197 09 797 are identical with those of the present application. The compounds in question are resins which are obtainable, for example, under the name of Dowfax DM 645 (Dow Chemicals).

The educts corresponding to formulae (IV) and (V) are sulfonated in a known manner with gaseous $SO_3$. The sulfonation products are not neutralized, but are present as free acids. The sulfonation of the educts can be carried out by a continuous process in a falling film reactor. The gaseous sulfur trioxide is produced in situ by pyrolysis of pure sulfur. The polyalkyl formaldehyde resin used is preferably reacted with sulfur trioxide in an equimolar ratio. The reaction itself advantageously takes place at a temperature of 75 to 80° C. The end product is preferably not neutralized. The sulfonation products are obtained in the form of aqueous solutions which may be directly formulated and used as asphaltene dispersants without any further steps.

In another embodiment, an asphaltene dispersant additive includes a compound of formula (VI):

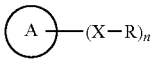

(VI)

wherein A is an optionally substituted ring system containing 6 to 14 carbon atoms; n is at least 1 and may equal the number of positions available for substitution in A; each X is independently a linker group; and each R is independently a hydrocarbyl group containing 10 to 25 carbon atoms. The compound of formula (I) is an amphiphilic molecule primarily consisting of two active parts; an adsorbing part (ring system A), which sticks to the surface of the asphaltene particle and which carries a long chain (X—R) attached to the ring. A is a primarily aromatic, largely flat molecule whose ring(s) give sufficient interactions through van der Waal's forces to attach itself to the similarly aromatic asphaltene. Thus it provides an anchor for the chain which is much longer and extends into the oil. The chain, being primarily aliphatic, is surrounded by a good solvent, such as oil, and adopts an attitude with many possible conformations while attached to the asphaltene particle at one end through the ring system A.

In one embodiment, A is naphthalene, X is selected from a $C_1$ to $C_4$ alkyl ether group, a $C_1$ to $C_4$ alkyl thio group and a $C_1$ to $C_4$ alkyl amino group, n is 1 and R is a $C_{12}$ to $C_{16}$ alkyl chain. In another embodiment, A is naphthalene, X is selected from an ether link, an amine link or a thio ether link, n is 1 and R is a $C_{14}$ to $C_{18}$ alkyl chain. In another embodiment, A is naphthalene, X is selected from an ether link, an amine link or a thio ether link, n is 1 and R is a $C_{16}$ alkyl chain. In another embodiment, A is naphthalene, X is an ether link, n is 1 and R is n-hexadecyl.

In another embodiment, an asphaltene dispersant additive includes a dendrimeric compound. Dendrimeric compounds are in essence three-dimensional, highly branched oligomeric or polymeric molecules comprising a core, a number of branching generations and an external surface composed of end groups. A branching generation is composed of structural units, which are bound radially to the core or to the structural units of a previous generation and which extend outwards. The structural units have at least two reactive mono-functional groups and/or at least one mono-functional group and one multifunctional group. The term multifunctional is understood as having a functionality of 2 or higher. To each functionality a new structural unit may be linked, a higher branching generation being produced as a result. The structural units can be the same for each successive generation but they can also be different. The degree of branching of a particular generation present in a dendrimeric compound is defined as the ratio between the number of branchings present and the maximum number of branchings possible in a completely branched dendrimer of the same generation. The term functional end groups of a dendrimeric compound refer to those reactive groups which-form part of the external surface. Branchings may occur with greater or lesser regularity and the branchings at the surface may belong to different generations depending on the level of control exercised during synthesis. Dendrimeric compounds may have defects in the branching structure, may also be branched asymmetrically or have an incomplete degree of branching in which case the dendrimeric compound is said to contain both functional groups and functional end groups.

Dendrimeric compounds as referred to hereinabove have been described in, for example, International Patent Application Publications Nos. WO 93/14147 and WO 97/19987 and in Dutch Patent Application No. 9200043. Dendrimeric compounds have also been referred to as "starburst conjugates", see, for example, International Patent Application Publication No. WO 88/01180. Such compounds are described as being polymers characterised by regular dendrimeric (tree-like) branching with radial symmetry.

Functionalized dendrimeric compounds are characterized in that one or more of the reactive functional groups present in the dendrimeric compounds have been allowed to react with active moieties different from those featuring in the structural units of the starting dendrimeric compounds. These moieties can be selectively chosen such that, with regard to its ability to solubilize asphaltenes, the functionalized dendrimeric compound outperforms the dendrimeric compound.

The hydroxyl group is one example of a functional group and functional end group of a dendrimeric compound. Dendrimeric compounds containing hydroxyl groups can be functionalized through well-known chemical reactions such as esterification, etherification, alkylation, condensation and the like. Functionalized dendrimeric compounds also include compounds that have been modified by related but not identical constituents of the structural units such as different amines, which as such may also contain hydroxyl groups.

A preferred class of dendrimeric compounds capable of solubilizing asphaltenes comprises the so-called hyperbranched polyesteramides, commercially referred to as HYBRANES (the word HYBRANE is a trademark). The preparation of such compounds has been described in more detail in International Patent Application Nos. WO-A-99/16810, WO-A-00/58388 and WO-A-00/56804. Accordingly, the dendrimeric compound is preferably a condensation polymer containing ester groups and at least one amide group in the backbone, having at least one hydroxyalkylamide end group and having a number average molecular weight of at least 500 g/mol. This class of polymers has a lower degree of branching than the poly(propylene imine) dendrimers described in WO-A-93/14147, but still retains the non-linear shape and the high number of reactive end groups, which are characteristic of dendrimeric compounds. Compounds belonging to this class of dendrimers are suitably produced by reacting a cyclic anhydride with an alkanolamine, giving rise to dendrimeric compounds by allowing them to undergo a number of (self-) condensation reactions leading to a predetermined level of branching. It is also possible to use more than one cyclic anhydride and/or more than one alkanolamine.

The alkanolamine may be a dialkanolamine, a trialkanolamine or a mixture thereof. Examples of suitable dialkanolamines are 3-amino-1,2-propanediol, 2-amino-1,3-propanediol, diethanolamine bis(2-hydroxy-1-butyl) amine, dicyclohexanolamine and diisopropanolamine. An example of a suitable trialkanolamine is tris(hydroxymethyl) amino methane or triethanolamine.

Suitable cyclic anhydrides comprise succinic anhydride, glutaric anhydride, tetrahydrophthalic anhydride, hexahydrophthalic anhydride, phthalic anhydride, norbornene-2,3-dicarboxylic anhydride, and naphthalenic dicarboxylic anhydride. The cyclic anhydrides may contain substituents, in particular hydrocarbon (alkyl or alkenyl) substituents. The substituents suitably comprise from 1 to 15 carbon atoms. In another embodiment the cyclic anhydride contains a polyalkenyl substituent. Suitably, the alkene from which the polyalkylene chain has been built is an ethylenically unsaturated hydrocarbon containing from 2 to 10, preferably from 2 to 6 carbon atoms. The alkene is suitably ethene, propene, butene, isobutene, pentene or hexene. Most preferred is a poly(isobutenyl) chain as substituent. The chain may have various lengths. Good results are obtainable with substituents comprising from 6 to 50 alkene monomers. More preferred is a chain with from 10 to 40 alkene monomers. Suitable non-polymeric examples of substituted cyclic anhydrides include. 4-methylphthalic anhydride, 4-methyltetrahydro- or 4-methylhexahydrophthalic anhydride, methyl succinic anhydride and 2-dodecenyl succinic anhydride. Mixtures of anhydrides can also be used.

In one embodiment, a mixture of succinic anhydride and poly(isobutenyl)succinic anhydride is used. The molar ratio between succinic anhydride to poly(isobutenyl)-succinic anhydride suitably ranges from 1:9 to 9:1, preferably from 2:3 to 9:1. The self-condensation reaction is suitably carried out without a catalyst at temperatures between 100 and 200° C. By carrying out such self-condensation reactions compounds will be obtained having amide-type nitrogen moieties as branching points and with hydroxyl end groups in the base polymer. Depending on the reaction conditions, predetermined molecular weight ranges and number of end groups can be set. For instance, using hexahydrophthalic anhydride and di-isopropanolamine polymers can be produced having a number average molecular weight tuned between 500 and 50,000, preferably between 670 and 10,000, more preferably between 670 and 5000. The number of hydroxyl groups per molecule in such case is suitably in the range between 0 and 13.

The functional end groups, in particular hydroxyl groups, of the polycondensation products can be modified by further reactions as disclosed in the above-mentioned applications WO-A-00/58388 and WO-A-00/56804. Suitable modification can take place by partial replacement of the alkanolamine by other amines, such as secondary amines, e.g. N,N-bis-(3-dimethylaminopropyl)amine, morpholine or non-substituted or alkyl-substituted piperazine, in particular N-methyl piperazine. The use of N,N-bis-(dialkylaminoalkyl)amines results in dendrimeric polymers that have been modified to have tertiary amine end groups. In particular, the products prepared by the polycondensation of 2-dodecenyl succinic anhydride or hexahydrophthalic anhydride with di-isopropanolamine that have been modified by morpholine, tertiary amine or non-substituted or alkyl-substituted piperazine end groups are very suitable for use in the process of the present invention. A preferred type of modification can be obtained by reaction of at least part of the hydroxyl end groups with acids or acid anhydrides. In one embodiment, the hydroxyl groups can be modified by a reaction with an organic acid or an acid anhydride, such as with succinic anhydride, alkenyl succinic anhydride, hexahydrophthalic anhydride, coco fatty acid or lauric acid.

In another embodiment, an acid anhydride is used that contains a polyalkenyl substituent. Suitably, the alkene from which the polyalkylene chain has been built is an ethylenically unsaturated hydrocarbon containing from 2 to 10 carbon atoms. The alkene is suitably ethene, propene, butene, isobutene, pentene or hexene. Most preferred is a poly(isobutenyl) chain as substituent. The chain may have various lengths, e.g., substituents comprising from 6 to 50 alkene monomers. In one embodiment, a poly(isobutylene) chain as substituent to succinic acid anhydride is used. In this way the dendrimeric compound contains hydroxyl functional groups and carboxylic functional groups.

In another embodiment, an asphaltene dispersant additive includes a polyester amide obtainable by a two-stage reaction in which (A) a polyisobutylene is reacted with at least monounsaturated acids containing 3 to 21 carbon atoms or derivatives thereof, either (A.1) in the presence of radical initiators at temperatures of 65 to 100° C. or (A.2) without radical initiators, optionally catalyzed by Lewis acids, at 150 to 250° C., and (B) an alkylamine with the general formula R—$NH_2$, in which R is an alkyl group containing 1 to 4 carbon atoms, is added to the product thus obtained and the mixture is stirred at 60 to 100° C. and then cooled and the product is isolated in known manner.

The polyester amides are based on polyisobutylene, a raw material which is industrially obtained by polymerization of isobutylene. The polyisobutylenes can have molecular weights of 500 to 50,000, preferably in the range from 1,000 to 25,000 and more preferably in the range from 1,500 to 15,000. The polyisobutylenes are introduced into a reaction vessel at temperatures of at least 60° C. and the unsaturated acids are then added. These acids or their derivatives are at least mono-olefinically unsaturated and preferably contain 3 to 7 carbon atoms. The anhydrides are particularly preferred. A preferred anhydride is maleic anhydride. However, maleic acid or fumaric acid or their esters or acrylic acid, methacrylic acid and derivatives thereof are also suitable components in step (A).

In one embodiment, the reaction in the first step takes place in the presence of radical initiators, such as azo-bis-isobutyronitrile (AIBN), dibenzoyl peroxides, tert-amyl peroxy-2-ethylhexanoate, tert-butyl peroxi-2-ethylhexanoate, tert-butyl peroxyisobutyrate and tert-butyl monoperoxymaleate.

Alternatively, it is also possible to work without radical initiators. The reaction according to (A.2) systematically represents an "ene" reaction, it being possible to carry this out in the presence of catalysts selected from the group of Lewis acids. Suitable Lewis acids include, for example, the bromides of phosphorus and aluminum, the chlorides of boron, aluminum, phosphorus, bismuth, arsenic, iron, zinc and tin. However, it is preferred to work without Lewis acids and to react the reactants polyisobutylene and carboxylic acid directly with one another. The reaction temperature in the case of variant (A.2) is higher than for (A.1), namely in the range from 150 to 250° C.

Step (A) of the process takes place under an inert atmosphere, for example, argon or nitrogen. The ratio by weight of polyisobutylene to carboxylic anhydride will range from 200:1 to 1:200. The choice of suitable ratios by weight is governed by the molecular weight of the components used and may readily be made by the expert.

The reaction time is at least 3 hours at a temperature of at least 60° C. in the case (A.1) or at least 150° C. in the case (A.2), higher temperatures and longer reaction times, for example, 4 to 8 hours being preferred. Thereafter, a suitable amine with the formula R—$NH_2$ may be added to the reaction mixture. However, the reaction mixture may also first be freed from unreacted anhydride, preferably by distillation under reduced pressure, and the reaction mixture thus worked up subsequently reacted with the amine at a temperature of at least 50° C. Under the effect of the exothermic reaction of the polyisobutylene/anhydride product with the amine, the temperature in the reaction vessel rises to around 100° C. The mixture containing the end product then cools down again and may then be used without further purification. Process steps (A) and (B) may be carried out in a single reaction stage or in two separate stages either continuously or in batches.

The amines of the formula R—$NH_2$ are known compounds, such as monoethanolamine. The ratio by weight between polyisobutylene and amine can be between 100:1 and 10:1

In another embodiment, an asphaltene dispersant additive includes cardanol-aldehyde resins. In general, cardanol-aldehyde resins are obtainable by reacting cardanol with a compound of the formula (VII)

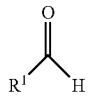

(VII)

in which $R^1$ is H, CHO, COOH, $COOR^2$ or $R^2$, and $R^2$ is a $C_1$ to $C_{30}$-alkyl, $C_2$ to $C_{30}$-alkenyl, $C_6$ to $C_{18}$-aryl or a $C_7$ to $C_{30}$-alkylaryl, and which have a number-average molecular weight of from 250 to 100 000 units. Cardanol is a constituent of oil that is obtained from the shell of cashew kernels.

In general, the one or more asphaltene dispersant additives will be added to the second hydrocarbon-containing fluid at a concentration of from about 0.1 to about 50,000 mg of asphaltene dispersant additive per kilogram of hydrocarbon-containing fluid.

Figure 13:
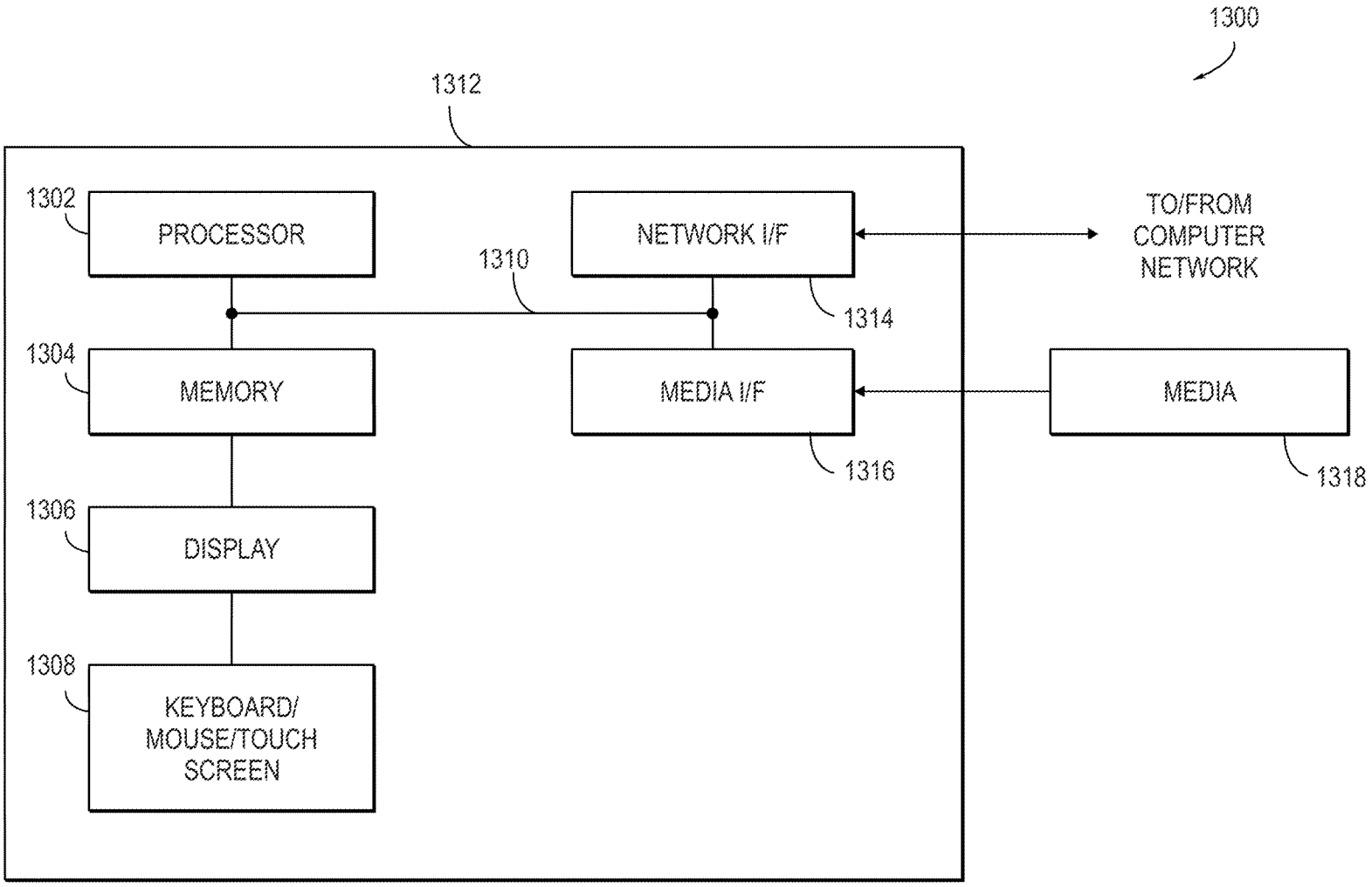
FIG. 13 illustrates a computer system in accordance with which one or more embodiments of the invention can be implemented, according to an exemplary embodiment of the invention.

FIG. 13 illustrates a computer system 1300 in accordance with which one or more embodiments of the method can be implemented. That is, one, more than one, or all of the components and/or functionalities shown and described in the context above may be implemented via the computer system depicted in FIG. 13.

By way of illustration, FIG. 13 depicts a processor 1302, a memory 1304, and an input/output (I/O) interface formed by a display 1306 and a keyboard/mouse/touchscreen 1308. More or less devices may be part of the I/O interface. The processor 1302, memory 1304 and I/O interface are interconnected via computer bus 1310 as part of a processing unit or system 1312 (such as a computer, workstation, server, client device, etc.). Interconnections via computer bus 1310 are also provided to a network interface 1314 and a media interface 1316. Network interface 1314 (which can include, for example, transceivers, modems, routers and Ethernet cards) enables the system to couple to other processing systems or devices (such as remote displays or other computing and storage devices) through intervening private or public computer networks (wired and/or wireless). Media interface 1316 (which can include, for example, a removable disk drive) interfaces with media 1318.

The processor 1302 can include, for example, a central processing unit (CPU), a microprocessor, a microcontroller, an application-specific integrated circuit (ASIC), a field programmable gate array (FPGA) or other type of processing circuitry, as well as portions or combinations of such circuitry elements. Components of systems as disclosed herein can be implemented at least in part in the form of one or more software programs stored in memory and executed by a processor of a processing device such as processor 1302. Memory 1304 (or other storage device) having such program code embodied therein is an example of what is more generally referred to herein as a processor-readable storage medium. Articles of manufacture comprising such processor-readable storage media are considered embodiments of the invention. A given such article of manufacture may comprise, for example, a storage device such as a storage disk, a storage array or an integrated circuit containing memory. The term "article of manufacture" as used herein should be understood to exclude transitory, propagating signals.

Furthermore, memory 1304 may comprise electronic memory such as random access memory (RAM), read-only memory (ROM) or other types of memory, in any combination. The one or more software programs when executed by a processing device such as the processing unit or system 1312 causes the device to perform functions associated with one or more of the components/steps of system/methodologies described above. One skilled in the art would be readily able to implement such software given the teachings provided herein. Other examples of processor-readable storage media embodying embodiments of the invention may include, for example, optical or magnetic disks.

Still further, the I/O interface formed by display 1306 and keyboard/mouse/touchscreen 1308 is used for inputting data to the processor 1302 and for providing initial, intermediate and/or final results associated with the processor 1302.

Figure 14:
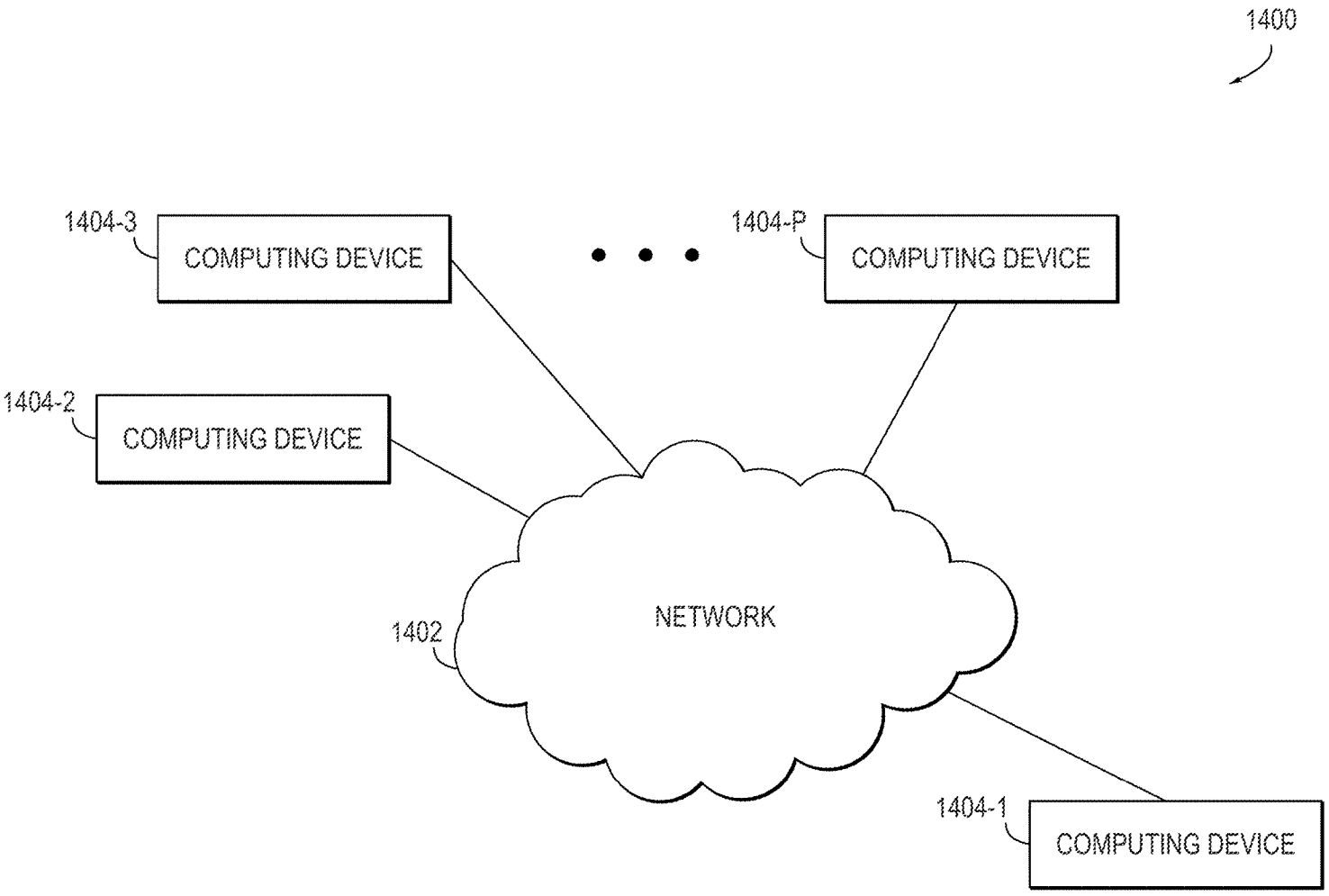
FIG. 14 illustrates a distributed communications/computing network in accordance with which one or more embodiments of the invention can be implemented, according to an exemplary embodiment of the invention

FIG. 14 illustrates a distributed communications/computing network (processing platform) in accordance with which one or more embodiments of the invention can be implemented. By way of illustration, FIG. 14 depicts a distributed communications/computing network (processing platform) 1400 that includes a plurality of computing devices 1404-1 through 1404-P (herein collectively referred to as computing devices 1404) configured to communicate with one another over a network 1402.

It is to be appreciated that one, more than one, or all of the computing devices 1404 in FIG. 14 may be configured as shown in FIG. 13. It is to be appreciated that the methodologies described herein may be executed in one or more such computing devices 1404, or executed in a distributed manner across two or more such computing devices 1404. It is to be further appreciated that a server, a client device, a processing device or any other processing platform element may be viewed as an example of what is more generally referred to herein as a "computing device." The network 1402 may include, for example, a global computer network such as the Internet, a wide area network (WAN), a local area network (LAN), a satellite network, a telephone or cable network, or various portions or combinations of these and other types of networks (including wired and/or wireless networks).

As described herein, the computing devices 1404 may represent a large variety of devices. For example, the computing devices 1404 can include a portable device such as a mobile telephone, a smart phone, personal digital assistant (PDA), tablet, computer, a client device, etc. The computing devices 1404 may alternatively include a desktop or laptop personal computer (PC), a server, a microcomputer, a workstation, a kiosk, a mainframe computer, or any other information processing device which can implement any or all of the techniques detailed in accordance with one or more embodiments of the invention.

One or more of the computing devices 1404 may also be considered a "user." The term "user," as used in this context, should be understood to encompass, by way of example and without limitation, a user device, a person utilizing or otherwise associated with the device, or a combination of both. An operation described herein as being performed by a user may therefore, for example, be performed by a user device, a person utilizing or otherwise associated with the device, or by a combination of both the person and the device, the context of which is apparent from the description.

Additionally, as noted herein, one or more modules, elements or components described in connection with embodiments of the invention can be located geographically-remote from one or more other modules, elements or components. That is, for example, the modules, elements or components shown and described above can be distributed in an Internet-based environment, a mobile telephony-based environment, a kiosk-based environment and/or a local area network environment. The transaction analysis system, as described herein, is not limited to any particular one of these implementation environments. However, depending on the operations being performed by the system, one implementation environment may have some functional and/or physical benefits over another implementation environment.

The processing platform 1400 shown in FIG. 14 may comprise additional known components such as batch processing systems, parallel processing systems, physical machines, virtual machines, virtual switches, storage volumes, etc. Again, the particular processing platform shown in this figure is presented by way of example only, and may include additional or alternative processing platforms, as well as numerous distinct processing platforms in any combination. Also, numerous other arrangements of servers, clients, computers, storage devices or other components are possible in processing platform 1400.

Furthermore, it is to be appreciated that the processing platform 1400 of FIG. 14 can comprise virtual machines (VMs) implemented using a hypervisor. A hypervisor is an example of what is more generally referred to herein as "virtualization infrastructure." The hypervisor runs on physical infrastructure. As such, the techniques illustratively described herein can be provided in accordance with one or more cloud services. The cloud services thus run on respective ones of the virtual machines under the control of the hypervisor. Processing platform 1400 may also include multiple hypervisors, each running on its own physical infrastructure. Portions of that physical infrastructure might be virtualized.

As is known, virtual machines are logical processing elements that may be instantiated on one or more physical processing elements (e.g., servers, computers, processing devices). That is, a "virtual machine" generally refers to a software implementation of a machine (i.e., a computer) that executes programs like a physical machine. Thus, different virtual machines can run different operating systems and multiple applications on the same physical computer. Virtualization is implemented by the hypervisor which is directly inserted on top of the computer hardware in order to allocate hardware resources of the physical computer dynamically and transparently. The hypervisor affords the ability for multiple operating systems to run concurrently on a single physical computer and share hardware resources with each other.

It is to be appreciated that combinations of the different implementation environments are contemplated as being within the scope of embodiments of the invention. One of ordinary skill in the art will realize alternative implementations given the illustrative teachings provided herein.

Other exemplary embodiments herein include a method for improving flow of a hydrocarbon-containing fluid from a well, a wellhead or a production line proximate the wellhead, the method comprising the steps of:

(a) receiving data corresponding to an asphaltene content in a hydrocarbon-containing fluid located in a well, a wellhead or a production line proximate the wellhead; wherein the data is derived from:

(i) providing one or more carbonaceous deposits from the hydrocarbon-containing fluid located in the well, the wellhead or the production line proximate the wellhead, wherein the one or more carbonaceous deposits have an inorganic portion and an organic portion;

(ii) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(iii) removing the solid particles of the inorganic portion of the one or more carbonaceous deposits from the first solution to provide a second solution containing the dissolved organic portion;

(iv) contacting the second solution with one or more alkane mobile phase solvents and capturing precipitated asphaltenes in one or more low volume filters comprising a porous filter element comprising an area through which a fluid may flow;

(v) determining one or more solubility characteristics of the precipitated asphaltenes;

(vi) analyzing the one or more solubility characteristics of the precipitated asphaltenes;

(vii) determining an asphaltene content of the second solution from the analyzing step (vi); and (b) applying preventative measures to the hydrocarbon-containing fluid located in the well, the wellhead or a production line proximate the wellhead based on the asphaltene content.

Another exemplary embodiment herein includes a method for monitoring changes in asphaltene precipitation tendencies in a hydrocarbon-containing fluid located in a well, a wellhead or a production line proximate the wellhead comprising the steps of:

(a) providing one or more carbonaceous deposits from a hydrocarbon-containing fluid located in a well, a wellhead or a production line proximate the wellhead, wherein the one or more carbonaceous deposits have an inorganic portion and an organic portion;

(b) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(c) removing the solid particles of the inorganic portion of the one or more carbonaceous deposits from the first solution to provide a second solution containing the dissolved organic portion;

(d) contacting the second solution with one or more alkane mobile phase solvents and capturing any precipitated asphaltenes in one or more low volume filters comprising a porous filter element comprising an area through which a fluid may flow;

(e) determining one or more solubility characteristics of the precipitated asphaltenes;

(f) analyzing the one or more solubility characteristics of the precipitated asphaltenes; and (g) determining an asphaltene content of the second solution from the analyzing step (f).

Yet another exemplary embodiment herein includes a method for determining an effectiveness of one or more asphaltene dispersant additives for inhibiting or preventing asphaltene precipitation in a hydrocarbon-containing fluid located in a well, wellhead or a production line proximate the wellhead comprising the steps of:

(a) providing one or more carbonaceous deposits from a hydrocarbon-containing fluid located in a well, a wellhead or a production line proximate the wellhead, wherein the one or more carbonaceous deposits have an inorganic portion and an organic portion;

(b) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(c) removing the solid particles of the inorganic portion of the one or more carbonaceous deposits from the first solution to provide a second solution containing the dissolved organic portion;

(d) contacting the second solution with one or more alkane mobile phase solvents and capturing any precipitated asphaltenes in one or more low volume filters comprising a porous filter element comprising an area through which a fluid may flow;

(e) determining one or more solubility characteristics of the precipitated asphaltenes;

(f) analyzing the one or more solubility characteristics of the precipitated asphaltenes;

(g) determining an asphaltene content of the second solution from the analyzing step (f);

(h) providing one or more second carbonaceous deposits from the same hydrocarbon-containing fluid in step (a) and containing one or more asphaltene dispersant additives wherein the one or more second carbonaceous deposits have an inorganic portion and an organic portion;

(i) dissolving the organic portion of the one or more second carbonaceous deposits with one or more solvents having a solubility parameter of at least about 16.8 $MPa^{0.5}$ and to up to about 30.0 $MPa^{0.5}$ to provide a first solution comprising solid particles of the inorganic portion of the one or more second carbonaceous deposits and the dissolved organic portion;

(j) removing the solid particles of the inorganic portion of the one or more second carbonaceous deposits from the first solution to provide a second solution containing the dissolved organic portion;

(k) contacting the second solution with one or more alkane mobile phase solvents and capturing any precipitated asphaltenes in one or more of the same or different low volume filters;

(l) determining one or more solubility characteristics of the precipitated asphaltenes;

(m) analyzing the one or more solubility characteristics of the precipitated asphaltenes;

(n) determining an asphaltene content of the second solution from the analyzing step (m); and (o) comparing the asphaltene content from step (g) with the asphaltene content from step (n).

The following non-limiting examples are illustrative of the present invention.

EXAMPLE 1

Screening of additives to improve asphaltene solubility during surface production operations by using in-line filtration method.

In this example, an in-line filtration method was used to evaluate the effectiveness of two asphaltene dispersant additives to improve the solubility of asphaltenes in Crude Oil A during surface production operations. Two different additives were added to Crude Oil A at a concentration of 100 ppm with respect to crude oil. Solutions of the additives in toluene at the same concentrations (100 ppm) were prepared as reference samples.

The blends and the reference samples were tested using the in-line filtration technique. The setup for this method consisted of a HPLC system composed of a HP Series 1200 chromatograph and a Corona Ultra Detector charged aerosol detector (CAD) from Dionex operating at room temperature using low volume filter containing a 0.5 micron stainless steel porous filter element purchased from Restek (Cat. No. 24993), having a volume of 5 μL volume (see as http://www.restek.com/catalog/view/10607 as retrieved on Jun. 18, 2014). 4 microliters of the blend and reference samples were injected using a heptane mobile phase at a flow rate of 2 mL/min. The maltenes (heptane solubles) first eluted from the filter. After 2 min, the precipitated asphaltenes captured in the filter were eluted by using a blend a 90/10 methylene chloride/methanol blend (Solubility Parameter of 21.23 $MPa^{0.5}$) at a flow rate of 2 mL/min. After 4 min, the solvent was switched back to 100% heptane at a flow rate of 2 mL/min. The test lasted less than 8 minutes.

Figure 7:
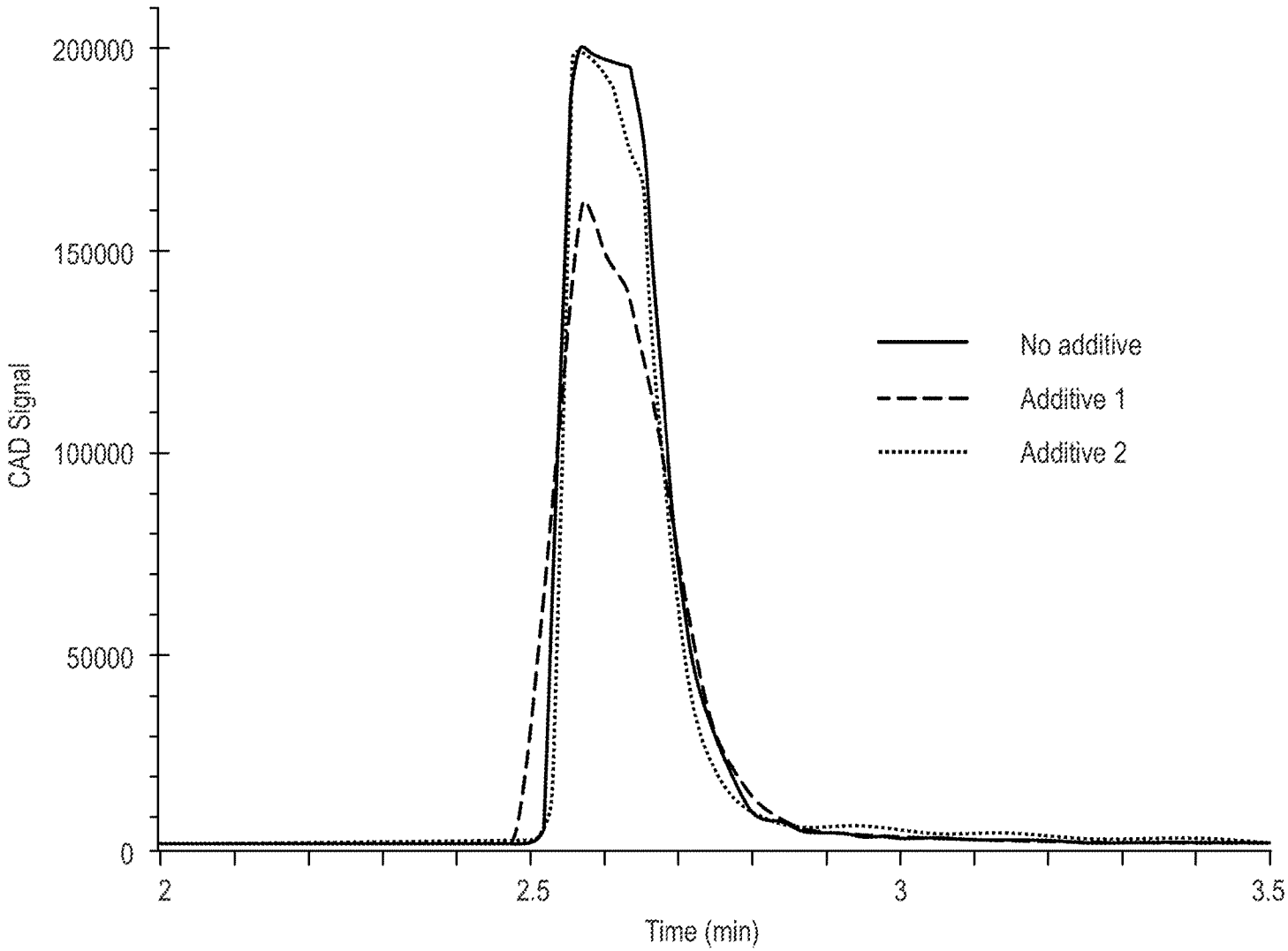
FIG. 7 shows a comparison between a crude oil with no additive and blends of the crude oil with two asphaltene dispersant additives.

The comparison between the original Crude Oil A (no additive) and blends of the crude oil with two asphaltene dispersant additives (additive 1 and additive 2) can be seen in FIG. 7. As shown, there is a reduction in the area of the asphaltene peaks in the presence of the two dispersants in comparison with the no-additive case.

The asphaltene contents were determined based on the signal coming from the CAD and using a calibration curve generated for asphaltenes. The calibration procedure was developed based on this equation:

$$\text{Log } M = D \log A + E \tag{1}$$

where D and E are the calibration constants, and A is the response of the CAD corresponding to the mass M.

In order to obtain the calibration curve, an asphaltene solution was prepared using asphaltenes extracted from Crude Oil A. The recommended concentration of this solution was 0.0100 g in 10 mL of methylene chloride. The response A was determined for different injection volumes in the range from 0.5 μL to 8 μL. Then, the responses were related to the masses injected M according to equation (1).

Regression analysis was used to calculate the calibration constants D and E. From equation (1) and the response obtained for the samples solutions it was possible to calculate the content of asphaltenes in the crude oil and the reference samples.

The percentage of reduction of asphaltenes is calculated by the following equation (2):

$$\text{\% Reduction Asphaltenes} = \frac{\left[\text{Asphaltene Content with Additives} - \text{Asphaltene Content without Additives}\right]}{\text{Asphaltene Content without Additives}} \times 100 \tag{2}$$

Using this equation, the percentage of reduction of asphaltenes is used to measure the effectiveness of asphaltene dispersant additives. The more negative this value is, the more efficient the additive is for keeping the asphaltenes dissolved in the hydrocarbon feedstock at any given temperature.

Figure 8:
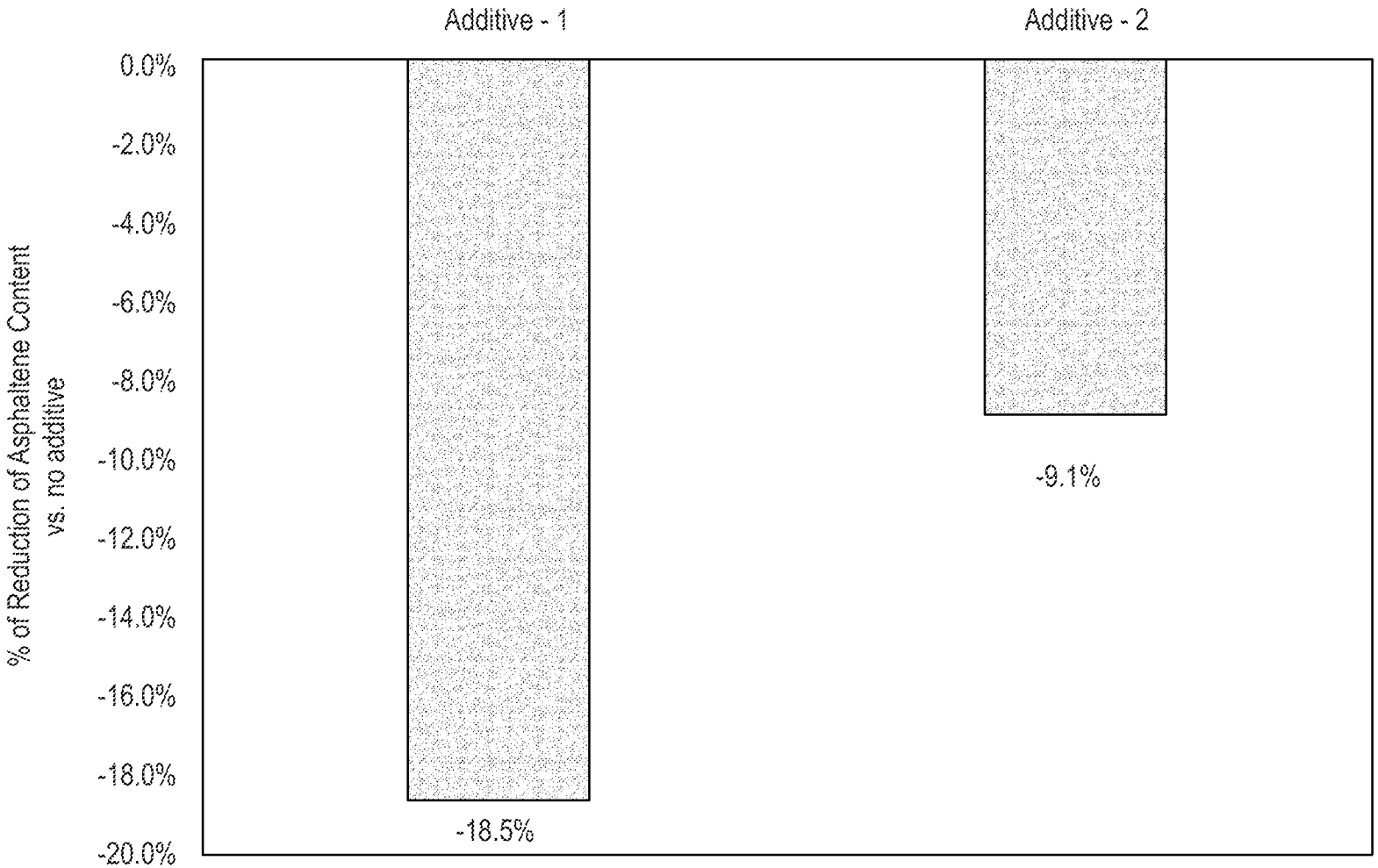
FIG. 8 shows the percentages of reduction of asphaltene content for two asphaltene dispersant additives vs. the case with no additive.

FIG. 8 shows the percentages of reduction of asphaltene content for two asphaltene dispersant additives vs. the case with no additive. In the presence of the additives, a 18.5% and 9.1% reduction in the asphaltene contents was measured. This example shows that the efficiency of asphaltene dispersants could be quantified by measuring the percentage of reduction of asphaltene area in the presence of the additive in comparison with the case without dispersant.

EXAMPLE 2

Asphaltene solubility characterization of a deposit and its parent crude oil.

A deposit sample and its corresponding crude oil were obtained from an oilfield produced by $CO_2$ flooding. The deposit was retrieved from a submersible pump. Crude Oil X is a medium crude oil (33.0 API) with an asphaltene content of 1.7 wt %.

In this example, an in-line filtration method was used to evaluate the colloidal stability of a crude oil towards asphaltene precipitation and to establish a comparison between the solubility characteristics of the asphaltenes present in the crude oil and those that preferentially precipitated to form the deposit.

The parent crude oil and its deposit were tested using the in-line filtration technique. The setup for this example consisted of a HPLC system composed of a HP Series 1100 liquid chromatograph and an Alltech ELSD 2000 detector operating at 75° C. A volumetric flow of 3.5 L/min of nitrogen was used for the nebulizing gas of the ELSD. The instrument uses a low volume filter containing a 0.5-micron stainless steel porous filter element purchased from Restek (Cat. No. 24993), having a volume of 5 μL volume (see as http://www.restek.com/catalog/view/10607 as retrieved on Jun. 18, 2014). The flow rate of the solvents during the tests was 2 mL/min.

Solutions of the crude oil (0.1 g) and deposit (0.01 g) were prepared in dichloromethane (10 mL) and 80 microliters were injected into a flow of heptane and passed through a filter. Asphaltenes precipitated as soon as the sample entered into contact with the heptane. The asphaltenes were retained by the filter while maltenes passed through it and reached the detector. Then, the mobile phase was changed gradually and continuously from pure n-heptane to 90/10 dichloromethane/methanol and then to 100% methanol. This procedure re-dissolved the asphaltenes gradually retained in the filter from the easy to dissolve (low solubility parameter) to the difficult to dissolve (high solubility parameter). The peaks also called "solubility profiles" (starting at around 6 min) shown in FIG. 9 correspond to the elution of asphaltenes. These peaks are curves that represent the solubility distributions of crude oil and deposit from the more soluble (left side of the peak) to the less soluble (right side of the peak) in hydrocarbons.

Figure 9:
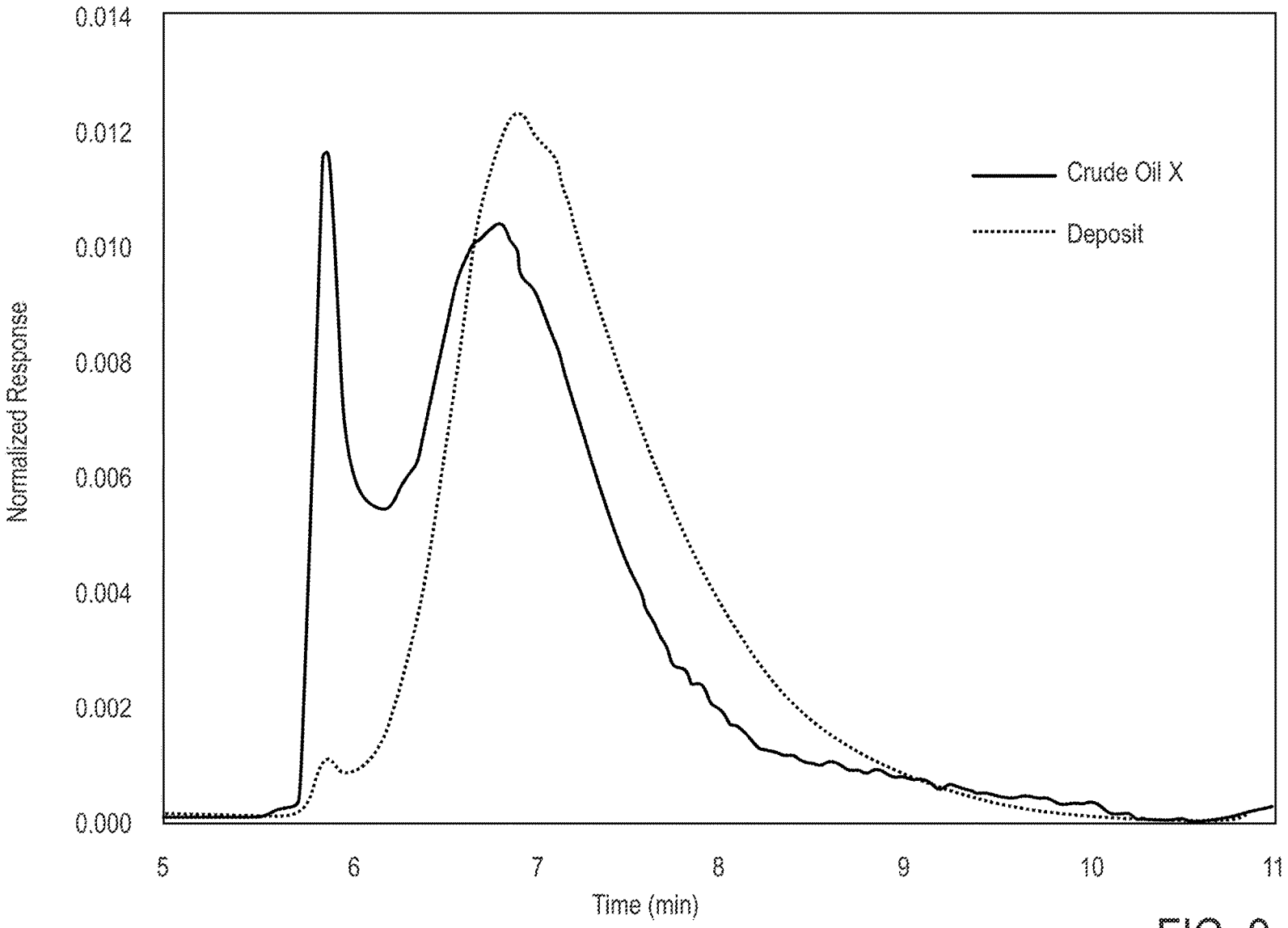
FIG. 9 shows a comparison between the solubility profile of a parent crude oil and its deposit.

Based on the curve shown in FIG. 9, the colloidal stability of the crude oil or ΔPS was measured. This parameter was measured as the difference in time between the maximum of the first peak and 75% of the total distribution. The 75% of the distribution was determined by the cumulative areas of the whole distribution that represents the solubility profile of the asphaltenes in the sample. The value obtained for the crude oil was 1.50, indicating low colloidal stability.

The comparison of crude oil and the deposit shown in FIG. 9 suggest that the asphaltene from the deposit elutes later. This finding indicates that the asphaltenes from the deposit are less soluble in hydrocarbons than those present in the crude oil. Calculations of the average time of elution (ATE) based on cumulative areas yield the following results: crude oil (6.82 min), deposit (7.16 min), a significant difference. These numbers can be translated to solubility parameter values based on an adequate calibration. During the in-line filtration, asphaltenes retained in the filter were dissolved gradually as the solubility parameter $\delta_A$ of the solvent blend was continuously changed. The solubility parameter of the asphaltenes was calculated based on the solubility parameter of the solvent $\delta_s$ at ATE (Average Time of Elution) using the following equations (3) and (4):

$$\delta_A=\delta_s \tag{3}$$

$$\delta_s=\phi_h\delta_h+\phi_{mc}\delta_{mc}+\phi_m\delta_m \tag{4}$$

where $\delta_h$, $\delta_{mc}$, and $\delta_m$ are the solubility parameters of heptane, methylene chloride, and methanol respectively and $\phi_h$, $\phi_{mc}$ and $\phi_m$ are the volumetric concentrations of heptane, methylene chloride and methanol at ATE (Average Time of Elution). Solubility parameter values for asphaltenes in the crude oil and the deposit were 17.4 $MPa^{0.5}$ and 17.8 $MPa^{0.5}$, respectively.

EXAMPLE 3

Comparison of solubility profile distributions of deposits obtained using pressure volume temperature (PVT) cell and core flood experiments.

Deposits came from two different experiments using the same crude oil X: PVT cell and core flood experiments. In both experiments, propane was used as the precipitating agent. In the PVT experiment using a phase behavior PVT cell made by Schlumberger (http://www.slb.com/~/media/Files/core_pvt_lab/product_sheets/fluid_lab_equipment_phase_behavior_cell_ps.pdf), the deposit was collected from a 4:1 propane/live crude oil experiment (122° F. [50° C.] and 1087 psi [7495 kPa]) after five days of stirring. The deposit was separated by filtration. In the propane core flood experiment, a displacement cell was placed vertically and flooded with 4 pore volumes of propane at a calculated rate of 1 ft/day [30.48 cm/day] at 120° F. [48.89° C.] and 1000 psi [6895 kPa]. Initial fluid saturations of So=92% and Sw=8%. After the experiment, sand recovered was solvent extracted to obtain the deposit.

In this example, the in-line filtration method, as described in Example 2, was used to evaluate the differences in the solubility distributions of the asphaltenes that preferentially precipitated to form the deposit. These experiments were aimed to evaluate solvent injection process for enhanced recovery of crude oils.

Figure 10:
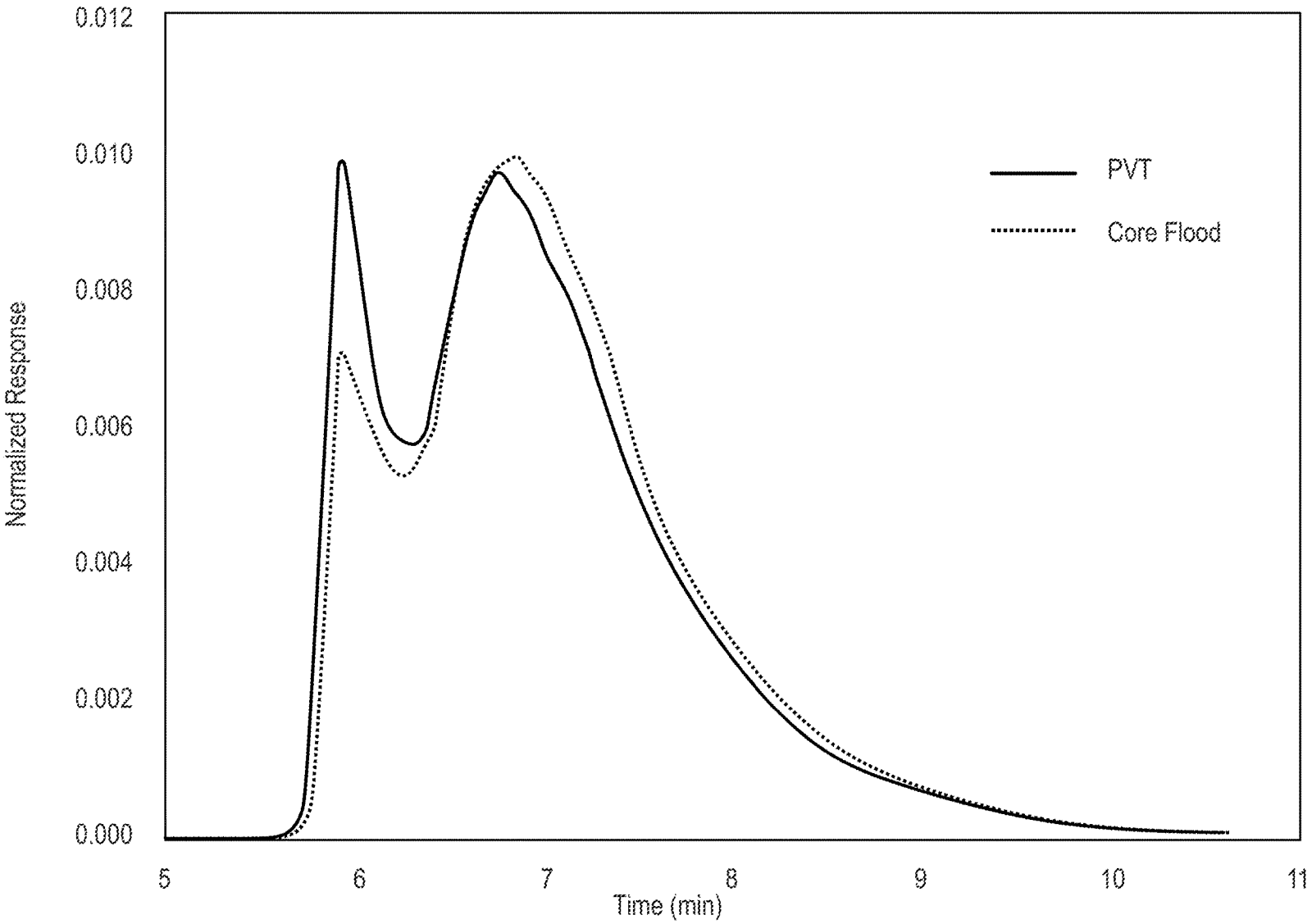
FIG. 10 shows a comparison of deposits obtained from different pressurized tests using propane.

The comparison of both deposits shown in FIG. 10 indicated that the Core Flood deposit is slightly displaced to the right and the first peak was smaller with respect to the PVT deposit from PVT experiment. This finding suggests that the material that precipitates during the Core Flood experiments was slightly less soluble. Calculations of the average time of elution (ATE) based on cumulative areas yield the following results: PVT deposit (6.84 min), deposit (6.94 min), a small difference. As described in Example 2, these numbers can be translated to solubility parameter values. For the Core Flood and PVT deposits, the values for the solubility parameters are 17.4 $MPa^{0.5}$ and 17.5 $MPa^{0.5}$, respectively.

EXAMPLE 4

Comparison of solubility profile distributions of asphaltenes obtained using different precipitant agents.

Two asphaltene samples were obtained from the same crude oil (7.7° API) following the standard procedures using heptane as precipitant (ASTM D6560) and pentane as precipitant (ASTM D4055). In this example, the in-line filtration method as described in Example 2 was used to evaluate the differences in the solubility distributions of the asphaltenes obtained using different extraction procedures.

Figure 11:
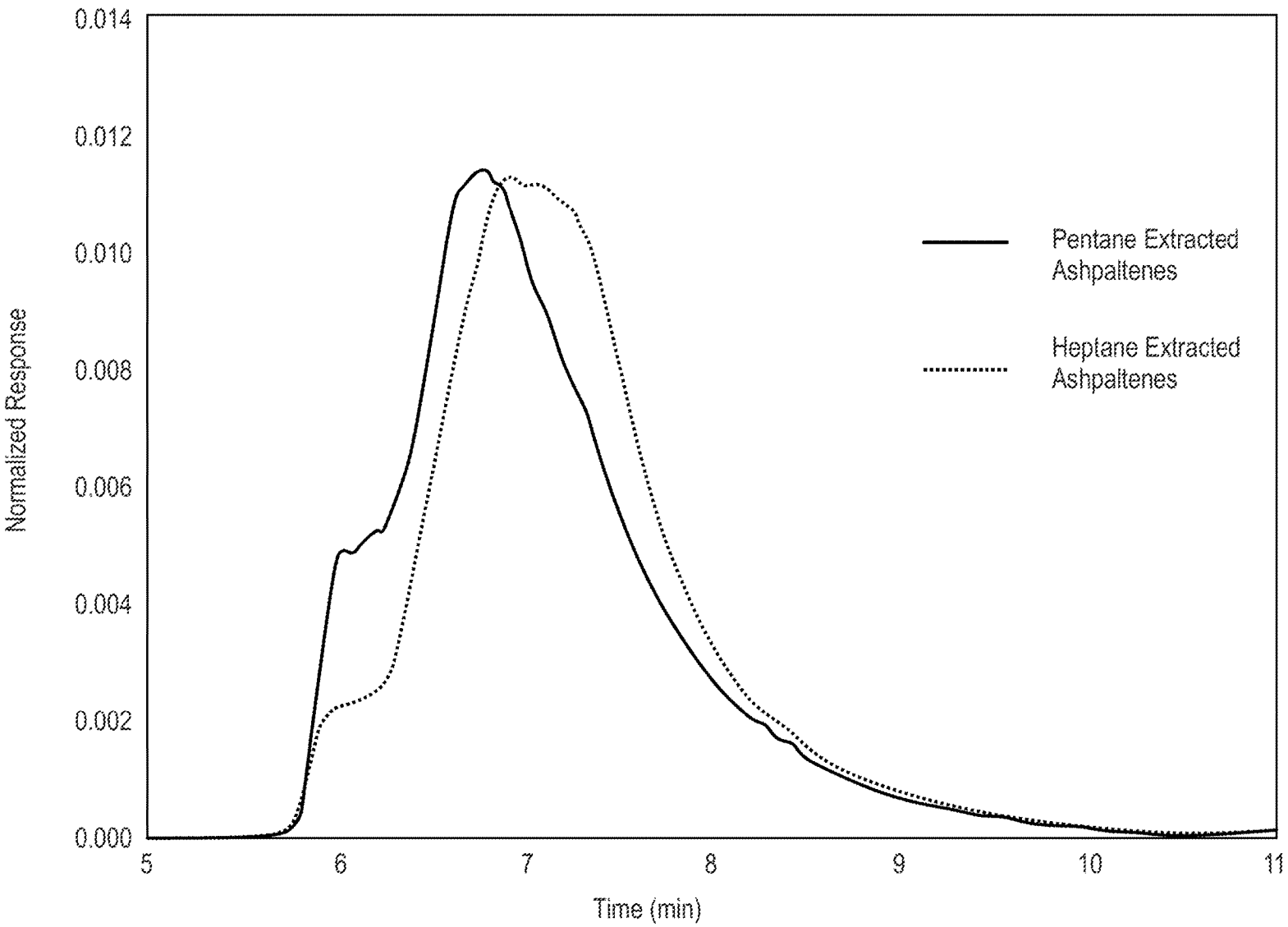
FIG. 11 shows a comparison of the solubility profile of pentane and heptane extracted asphaltenes.

The comparison of both asphaltenes shown in FIG. 11 indicates that the solubility profile of the asphaltene extracted using heptane was shifted to the right as compared to the asphaltene extracted using pentane. This finding indicates that the material that precipitates using heptane was less soluble. Calculations of the average time of elution (ATE) based on cumulative areas yield the following results: heptane asphaltenes (7.13 min), pentane asphaltenes (6.92 min). Average solubility parameter values for pentane asphaltenes and heptane asphaltenes are 17.5 $MPa^{0.5}$ and 17.7 $MPa^{0.5}$, respectively.

EXAMPLE 5

Evaluation of asphaltene deposition during PVT experiments.

Figure 12:
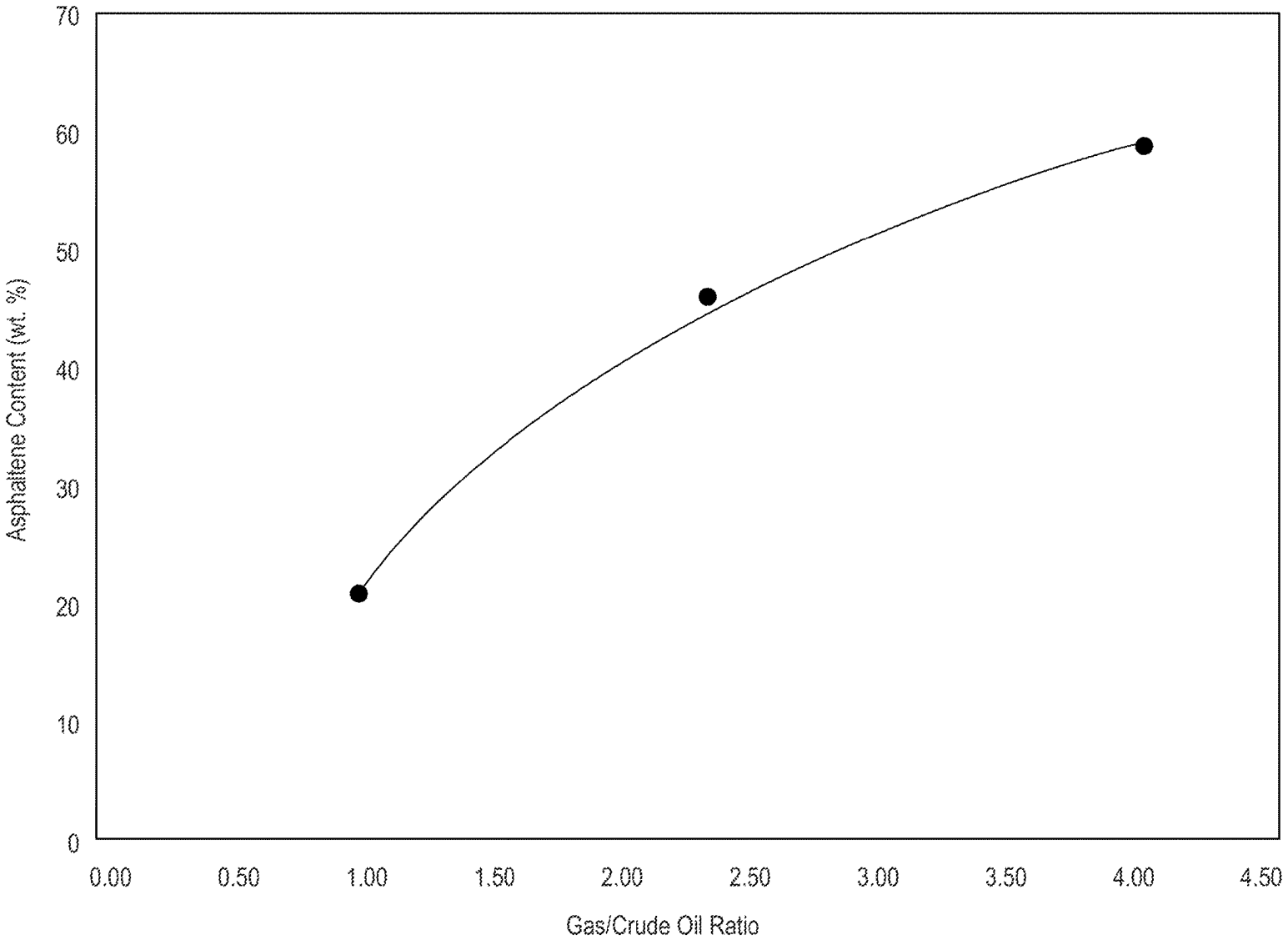
FIG. 12 shows the effect of the molar ratio gas/crude oil on asphaltene precipitation.

Precipitated material was recovered from PVT experiments carried out at 9000 psi (62053 kPa) and 245° F. (118° C.). In these experiments, a crude oil was blended with deep water gas (58 vol %. methane) until it reached equilibrium conditions after five days of stirring. The deposits were analyzed to obtained asphaltene content using the method described in Example 1. FIG. 12 shows the effect of the molar ratio gas/crude oil on asphaltene precipitation.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A method comprising the steps of:

(a) providing one or more carbonaceous deposits from a hydrocarbon-containing fluid located in a well, a wellhead or a production line proximate the wellhead, wherein the one or more carbonaceous deposits have an inorganic portion and an organic portion;

(b) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(c) removing the solid particles of the inorganic portion of the one or more carbonaceous deposits from the first solution to provide a second solution containing the dissolved organic portion, wherein the removing comprises one of filtering, centrifuging or decanting the solid particles of the inorganic portion of the one or more carbonaceous deposits from the first solution;

(d) contacting the second solution with one or more alkane mobile phase solvents and capturing any precipitated asphaltenes in one or more low volume filters comprising a porous filter element comprising an area through which a fluid may flow, wherein the one or more low volume filters have a volume of less than 100 μL;

(e) determining one or more solubility characteristics of the precipitated asphaltenes from step (d), wherein step (e) comprises either:

(1)(i) dissolving at least part of a first amount of the precipitated asphaltenes from step (d) in one or more first solvents having the solubility parameter at least about 0.7 $MPa^{0.5}$ higher than the solubility parameter of the one or more alkane mobile phase solvents to provide a first eluted fraction with a first amount of dissolved asphaltenes, and (1)(ii) dissolving a second amount of the precipitated asphaltenes from step (d) in one or more second solvents having the solubility parameter higher than the solubility parameter of the one or more first solvents, wherein the solubility parameter of the one or more second solvents is at least about 21 $MPa^{0.5}$ but no greater than about 30 $MPa^{0.5}$ to provide a second eluted fraction with a second amount of dissolved asphaltenes; or (2) dissolving the first amount of the precipitated asphaltenes and the second amount of the precipitated asphaltenes from step (d) by gradually and continuously changing the one or more alkane mobile phase solvents to a first final mobile phase solvent having the solubility parameter at least about 1 $MPa^{0.5}$ higher than the solubility parameter of the one or more alkane mobile phase solvents to provide an eluted fraction of the dissolved asphaltenes;

(f) analyzing the one or more solubility characteristics of the precipitated asphaltenes, which comprises monitoring either an amount of the first eluted fraction and the second eluted fraction from step (e)(1), or an amount of the eluted fraction from step (e)(2), from the one or more low volume filters with a liquid chromatography detector which generates a signal proportional to a concentration of the dissolved asphaltenes in either the first eluted fraction and the second eluted fraction from step (e)(1), or the eluted fraction from step (e)(2);

(g) determining an asphaltene content of the second solution from the analyzing step (f); and (h) applying one or more preventative measures to the hydrocarbon-containing fluid located in the well, the wellhead or the production line proximate the wellhead based on the asphaltene content.

2. The method of claim 1, wherein the one or more low volume filters have the volume from about 1 μL to less than 100 μL.

3. The method of claim 1, comprising calculating a percentage of each peak area for the first amount and the second amount of the dissolved asphaltenes from total peak areas, wherein the peak areas are derived from signals.

4. The method of claim 1, wherein step (e) includes steps (e)(1)(i) and (e)(1)(ii), and further wherein the step of determining the asphaltene content comprises:

calculating a peak area for each of the amounts of the dissolved asphaltenes, wherein peak areas are derived from signals;

correlating the peak area to an asphaltene mass; and adding each of the asphaltene masses (M) determined for the peak area to obtain a total asphaltene mass (TAM) according to the following equation:

$$TAM = \sum_{i=1}^{n} M_i$$

wherein M is the asphaltene mass determined for the peak area.

5. The method of claim 1, wherein step (e) includes steps (e)(1)(i) and (e)(1)(ii), and further comprising the step of determining one or more asphaltene stability parameters from the analyzing of step (f), wherein the step of determining the one or more asphaltene stability parameters comprises (i) calculating a peak area for each of the amounts of the dissolved asphaltenes, wherein peak areas are derived from signals; and (ii) calculating a ratio of calculated peak areas for each eluted fraction according to the following equation:

Ratio=(area peak 3+area peak 4)/(area peak 1+area peak 2)

wherein area peak 1 is a first peak area characterizing the first eluted fraction eluted from the one or more low volume filters, area peak 2 is a second peak area characterizing the second eluted fraction eluted from the one or more low volume filters, area peak 3 is a third peak area characterizing a third eluted fraction eluted from the one or more low volume filters and area peak 4 is a fourth peak area characterizing a fourth eluted fraction eluted from the one or more low volume filters.

6. The method of claim 1, wherein step (e)(2) comprises:

(i) gradually and continuously changing the one or more alkane mobile phase solvents to the first final mobile phase solvent having the solubility parameter at least 1 $MPa^{0.5}$ higher than the solubility parameter of the one or more alkane mobile phase solvents to dissolve the first amount of the precipitated asphaltenes to provide a first eluted fraction with the first amount of the dissolved asphaltenes; and (ii) gradually and continuously changing the first final mobile phase solvent to a second final mobile phase solvent having the solubility parameter at least 1 $MPa^{0.5}$ higher than the solubility parameter of the first final mobile phase solvent to dissolve the second amount of the precipitated asphaltenes to provide the second eluted fraction with the second amount of the dissolved asphaltenes.

7. The method of claim 6, wherein the step of determining the asphaltene content comprises:

calculating a peak area under an obtained second peak for the second amount of the dissolved asphaltenes, wherein the peak area is derived from the signal, correlating the peak area to an asphaltene mass; and determining a TAM according to the following equation:

$$TAM = \sum_{i=1}^{n} M_i$$

wherein M is the asphaltene mass determined for the peak area.

8. The method of claim 7, further comprising the step of determining one or more asphaltene stability parameters comprising calculating an average solubility parameter of the second amount of the dissolved asphaltenes.

9. The method of claim 1, wherein the step of providing the one or more carbonaceous deposits from the hydrocarbon-containing fluid comprises providing the one or more carbonaceous deposits from the hydrocarbon-containing fluid prior to or during Enhanced Oil Recovery (EOR).

10. The method of claim 1, wherein the step (h) of applying preventative measures comprises one or more of:

(h)(1) adding one or more asphaltene dispersant additives to the hydrocarbon-containing fluid; and (h)(2) adding a solvent to the hydrocarbon-containing fluid.

11. The method of claim 1, further comprising the steps of prior to step (h):

(i) providing one or more second carbonaceous deposits from the hydrocarbon-containing fluid in step (a) and containing one or more asphaltene dispersant additives wherein the one or more second carbonaceous deposits have the inorganic portion and the organic portion;

(j) dissolving the organic portion of the one or more second carbonaceous deposits with the one or more solvents having the solubility parameter of at least about 16.8 $MPa^{0.5}$ and to up to about 30.0 $MPa^{0.5}$ to provide the first solution comprising the solid particles of the inorganic portion of the one or more second carbonaceous deposits and the dissolved organic portion;

(k) removing the solid particles of the inorganic portion of the one or more second carbonaceous deposits from the first solution to provide the second solution containing the dissolved organic portion;

(l) contacting the second solution with the one or more alkane mobile phase solvents and capturing any of the precipitated asphaltenes in one or more of the same or different low volume filters, wherein the one or more low volume filters have a volume of less than 100 μL;

(m) determining the one or more solubility characteristics of the precipitated asphaltenes from step (l) wherein step (m) comprises either:

(1)(i) dissolving at least part of a first amount of the precipitated asphaltenes from step (d) in one or more first solvents having the solubility parameter at least about 0.7 $MPa^{0.5}$ higher than the solubility parameter of the one or more alkane mobile phase solvents to provide a first eluted fraction with a first amount of dissolved asphaltenes, and (1)(ii) dissolving a second amount of the precipitated asphaltenes from step (d) in one or more second solvents having the solubility parameter higher than the solubility parameter of the one or more first solvents, wherein the solubility parameter of the one or more second solvents is at least about 21 $MPa^{0.5}$ but no greater than about 30 $MPa^{0.5}$ to provide a second eluted fraction with a second amount of dissolved asphaltenes; or (2) dissolving the first amount of the precipitated asphaltenes and the second amount of the precipitated asphaltenes from step (d) by gradually and continuously changing the one or more alkane mobile phase solvents to a first final mobile phase solvent having the solubility parameter at least about 1 $MPa^{0.5}$ higher than the solubility parameter of the one or more alkane mobile phase solvents to provide an eluted fraction of the dissolved asphaltenes;

(n) analyzing the one or more solubility characteristics of the precipitated asphaltenes, which comprises monitoring either an amount of the first eluted fraction and the second eluted fraction from step (m)(1), or an amount of the eluted fraction from step (m)(2), from the one or more low volume filters with a liquid chromatography detector which generates a signal proportional to a concentration of the dissolved asphaltenes in either the first eluted fraction and the second eluted fraction from step (m)(1), or the eluted fraction from step (m)(2);

(o) determining the asphaltene content of the second solution from the analyzing step (n); and (p) comparing the asphaltene content from step (g) with the asphaltene content from step (o).

12. The method of claim 11, wherein the one or more asphaltene dispersant additives are added to a second hydrocarbon-containing fluid in an amount of about 0.1 to about 50,000 mg of asphaltene dispersant additive per kilogram of the second hydrocarbon-containing fluid.

13. A method for optimizing a concentration of one or more asphaltene dispersant additives in a hydrocarbon-containing fluid located in a well, a wellhead or a production line proximate the wellhead, the method comprising the steps of:

(a) selecting the concentration of the one or more asphaltene dispersant additives for adding to the hydrocarbon-containing fluid located in the well, the wellhead or the production line proximate the wellhead, wherein the selecting of the concentration of the one or more asphaltene dispersant additives comprises receiving data corresponding to an effectiveness of the concentration of the one or more asphaltene dispersant additives for inhibiting or preventing asphaltene precipitation in the hydrocarbon-containing fluid; wherein the data is derived from:

(i) providing one or more carbonaceous deposits from the hydrocarbon-containing fluid located in the well, the wellhead or the production line proximate the wellhead, wherein the one or more carbonaceous deposits have an inorganic portion and an organic portion;

(ii) dissolving the organic portion of the one or more carbonaceous deposits with one or more solvents having a solubility parameter of at least about 16.8 $MPa^{0.5}$ and up to about 30.0 $MPa^{0.5}$ to provide a first solution comprising solid particles of the inorganic portion of the one or more carbonaceous deposits and a dissolved organic portion;

(iii) removing the solid particles of the inorganic portion of the one or more carbonaceous deposits from the first solution to provide a second solution containing the dissolved organic portion, wherein the removing comprises one of filtering, centrifuging or decanting the solid particles of the inorganic portion of the one or more carbonaceous deposits from the first solution;

(iv) contacting the second solution with one or more alkane mobile phase solvents and capturing precipitated asphaltenes in one or more low volume filters comprising a porous filter element comprising an area through which a fluid may flow, wherein the one or more low volume filters have a volume of less than 100 μL;

(v) determining one or more solubility characteristics of the precipitated asphaltenes of step (iv), wherein step (v) comprises either:

(1)(i) dissolving at least part of a first amount of the precipitated asphaltenes from step (iv) in one or more first solvents having the solubility parameter at least about 0.7 $MPa^{0.5}$ higher than the solubility parameter of the one or more alkane mobile phase solvents to provide the first eluted fraction with a first amount of dissolved asphaltenes, and (1)(ii) dissolving a second amount of the precipitated asphaltenes from step (iv) in one or more second solvents having the solubility parameter higher than the solubility parameter of the one or more first solvents, wherein the solubility parameter of the one or more second solvents is at least about 21 $MPa^{0.5}$ but no greater than about 30 $MPa^{0.5}$ to provide a second eluted fraction with a second amount of dissolved asphaltenes; or (2) dissolving the first amount of the precipitated asphaltenes and the second amount of the precipitated asphaltenes from step (iv) by gradually and continuously changing the one or more alkane mobile phase solvents to a first final mobile phase solvent having the solubility parameter at least about 1 $MPa^{0.5}$ higher than the solubility parameter of the one or more alkane mobile phase solvents to provide an eluted fraction of the dissolved asphaltenes;

(vi) analyzing the one or more solubility characteristics of the precipitated asphaltenes, which comprises monitoring either an amount of the first eluted fraction and the second eluted fraction from step (v)(1), or an amount of the eluted fraction from step (v)(2), from the one or more low volume filters with a liquid chromatography detector which generates a signal proportional to a concentration of the dissolved asphaltenes in either the first eluted fraction and the second eluted fraction from step (v)(1), or the eluted fraction from step (v)(2);

(vii) determining an asphaltene content of the second solution from the analyzing step (vi);

(viii) providing one or more second carbonaceous deposits from the hydrocarbon-containing fluid in step (a) and containing one or more asphaltene dispersant additives wherein the one or more second carbonaceous deposits have the inorganic portion and the organic portion;

(ix) dissolving the organic portion of the one or more second carbonaceous deposits with the one or more solvents having the solubility parameter of at least about 16.8 $MPa^{0.5}$ and to up to about 30.0 $MPa^{0.5}$ to provide the first solution comprising the solid particles of the inorganic portion of the one or more second carbonaceous deposits and the dissolved organic portion;

(x) removing the solid particles of the inorganic portion of the one or more second carbonaceous deposits from the first solution to provide the second solution containing the dissolved organic portion;

(xi) contacting the second solution with the one or more alkane mobile phase solvents and capturing the precipitated asphaltenes in one or more of the same or different low volume filters, wherein the one or more low volume filters have a volume of less than 100 μL;

(xii) determining the one or more solubility characteristics of the precipitated asphaltenes of step (xi), wherein step (xii) comprises either:

(1)(i) dissolving at least part of a first amount of the precipitated asphaltenes from step (x) in one or more first solvents having the solubility parameter at least about 0.7 $MPa^{0.5}$ higher than the solubility parameter of the one or more alkane mobile phase solvents to provide the first eluted fraction with a first amount of dissolved asphaltenes, and (1)(ii) dissolving a second amount of the precipitated asphaltenes from step (x) in one or more second solvents having the solubility parameter higher than the solubility parameter of the one or more first solvents, wherein the solubility parameter of the one or more second solvents is at least about 21 $MPa^{0.5}$ but no greater than about 30 $MPa^{0.5}$ to provide a second eluted fraction with a second amount of dissolved asphaltenes; or (2) dissolving the first amount of the precipitated asphaltenes and the second amount of the precipitated asphaltenes from step (x) by gradually and continuously changing the one or more alkane mobile phase solvents to a first final mobile phase solvent having the solubility parameter at least about 1 $MPa^{0.5}$ higher than the solubility parameter of the one or more alkane mobile phase solvents to provide an eluted fraction of the dissolved asphaltenes;

(xiii) analyzing the one or more solubility characteristics of the precipitated asphaltenes, which comprises monitoring either an amount of the first eluted fraction and the second eluted fraction from step (xii)(1), or an amount of the eluted fraction from step (xii)(2), from the one or more low volume filters with a liquid chromatography detector which generates a signal proportional to a concentration of the dissolved asphaltenes in either the first eluted fraction and the second eluted fraction from step (xii)(1), or the eluted fraction from step (xii)(2);

(xiv) determining the asphaltene content of the second solution from the analyzing step (xiii); and (xv) comparing the asphaltene content from step (vi) with the asphaltene content from step (xiv).

14. The method of claim 13, wherein the one or more low volume filters have the volume from about 1 μL to less than 100 μL.

15. The method of claim 13, comprising calculating a percentage of each peak area for the first amount and the second amount of the dissolved asphaltenes from total peak areas, wherein the peak areas are derived from signals.

16. The method of claim 13, wherein step (v) includes steps (v)(1)(i) and (v)(1)(ii), and further wherein the step (vii) comprises:

calculating a peak area for each of the amounts of the dissolved asphaltenes, wherein peak areas are derived from signals;

correlating the peak area to an asphaltene mass; and adding each of the asphaltene masses (M) determined for the peak area to obtain a total asphaltene mass (TAM) according to the following equation:

$$TAM = \sum_{i=1}^{n} M_i$$

wherein M is the asphaltene mass determined for the peak area.

17. The method of claim 13, wherein step (v) includes steps (v)(1)(i) and (v)(1)(ii), and further comprising the step of determining one or more asphaltene stability parameters from the analyzing of step (vi), wherein the step of determining the one or more asphaltene stability parameters comprises (i) calculating a peak area for each of the amounts of the dissolved asphaltenes, wherein peak areas are derived from signals; and (ii) calculating a ratio of calculated peak areas for each eluted fraction according to the following equation:

Ratio=(area peak 3+area peak 4)/(area peak 1+area peak 2)

wherein area peak 1 is a first peak area characterizing the first eluted fraction eluted from the one or more low volume filters, area peak 2 is a second peak area characterizing the second eluted fraction eluted from the one or more low volume filters, area peak 3 is a third peak area characterizing a third eluted fraction eluted from the one or more low volume filters and area peak 4 is a fourth peak area characterizing a fourth eluted fraction eluted from the one or more low volume filters.

* * * * *